US009904234B2

(12) United States Patent
Kudoh

(10) Patent No.: US 9,904,234 B2
(45) Date of Patent: Feb. 27, 2018

(54) ELECTROPHOTOGRAPHIC IMAGE FORMING METHOD

(71) Applicant: Konica Minolta, Inc., Tokyo (JP)

(72) Inventor: Koichi Kudoh, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/074,191

(22) Filed: Mar. 18, 2016

(65) Prior Publication Data

US 2016/0291503 A1 Oct. 6, 2016

(30) Foreign Application Priority Data

Mar. 30, 2015 (JP) ..... 2015-068701

(51) Int. Cl.
*G03G 21/06* (2006.01)
*G03G 15/08* (2006.01)
*G03G 15/00* (2006.01)

(52) U.S. Cl.
CPC ..... *G03G 21/06* (2013.01); *G03G 15/08* (2013.01); *G03G 15/75* (2013.01)

(58) Field of Classification Search
CPC .... G03G 21/06; G03G 21/49; G03G 5/14704; G03G 5/144; G03G 21/0094; G03G 13/06
USPC ..... 430/100
See application file for complete search history.

(56) References Cited

U.S. PATENT DOCUMENTS 3,932,877 A * 1/1976 Ohnishi ..... G03G 21/08 15/1.51
6,208,499 B1 * 3/2001 Yonekawa ..... H01T 19/04 361/213
2006/0008719 A1 * 1/2006 Niimi ..... G03G 5/0557 430/59.1
2006/0147717 A1 * 7/2006 Hasegawa ..... B41J 2/36 428/412
2006/0197823 A1 * 9/2006 Ohta ..... G03G 5/0564 347/127

(Continued)

FOREIGN PATENT DOCUMENTS

JP H11288121 A 10/1999
JP 2009069241 A 4/2009

OTHER PUBLICATIONS

Borsenberger, P.; Weiss, D. Organic Photoreceptors for Imaging Systems. Marcel-Dekker, Inc.: New York, 1993; pp. 6-17.*

(Continued)

*Primary Examiner* — Christopher D Rodee
(74) *Attorney, Agent, or Firm* — Lucas & Mercanti, LLP

(57) ABSTRACT

An electrophotographic image forming method includes: performing a reversal development process using an electrophotographic photoreceptor including a conductive support, and an undercoat layer, a photosensitive layer, and a surface protective layer, which are at least provided on the conductive support, wherein the surface protective layer includes at least a cured resin and a component capable of influencing frequency dependence of impedance, and the undercoat layer includes at least a metal oxide and has a thickness in the range of 1 to 30 μm; and performing an electrostatic discharge step including applying an AC voltage at 2 kHz or more, wherein the frequency of the AC voltage is increased depending on use history.

9 Claims, 5 Drawing Sheets

(56) References Cited

U.S. PATENT DOCUMENTS

2013/0223884 A1* 8/2013 Umemoto ..... G03G 15/0291
399/170

OTHER PUBLICATIONS

Diamond, Arthur S (editor) Handbook of Imaging Materials. New York: Marcel-Dekker, Inc. (2002) pp. 145-164.*

* cited by examiner

ELECTROPHOTOGRAPHIC IMAGE FORMING METHOD

The entire disclosure of Japanese Patent Application No. 2015-068701 filed on Mar. 30, 2015 including description, claims, drawings, and abstract are incorporated herein by reference in its entirety.

BACKGROUND OF THE INVENTION

1. Field of the Invention

The present invention relates to an electrophotographic image forming method. More specifically, the present invention relates to an electrophotographic image forming method in which transfer memory and photo-memory can be reduced while mechanical strength is maintained.

2. Description of the Related Art

In recent electrophotographic image forming processes, electrophotographic photoreceptors (hereinafter also simply referred to as "photoreceptors") are required to provide high image quality and have high durability.

One way to provide high durability is to form a surface protective layer on photoreceptors (see, for example, JP 11-288121 A and JP 2009-69241 A). There is also a conventional method in which a cured resin containing fine particles of a metal oxide or a fluororesin is added to the surface protective layer to improve the mechanical strength significantly and to reduce the surface resistance (friction).

Unfortunately, the surface protective layer can have an adverse effect on the electrostatic properties of photoreceptors and in particular can tend to cause transfer memory. Photoreceptors with the surface protective layer also have a problem in that transfer memory is more likely to occur as they are used more in the image forming process (in other words, according to use history).

To reduce the transfer memory, various attempts have been made, such as various modifications of the conditions of the image forming process in an electrophotographic image forming apparatus and addition of a charge transport material (CTM) (a component of a photoreceptor). However, such attempts are not enough.

SUMMARY OF THE INVENTION

The present invention has been made in view of the above problems and circumstances. An object of the present invention for solving the problems is to provide an electrophotographic image forming method in which transfer memory and photo-memory can be reduced while mechanical strength is maintained.

To solve the problems, the inventor has conducted studies on causes of the problems. In the process of conducting the studies, the inventor has found that if an electrostatic discharge method that includes applying an AC voltage at 2 kHz or more, wherein the frequency of the AC voltage is increased depending on use history, is used in an electrophotographic image forming method using a reversal development process, transfer memory and photo-memory (hereinafter, these memories are also collectively referred to as "image memory") can be reduced even when the electrophotographic photoreceptor used has a surface protective layer including a cured resin containing fine particles of a metal oxide or a fluororesin (a component capable of influencing the frequency dependence of impedance). The inventor has accomplished the present invention based on this finding.

Although described in detail below, the reason why these features work may be briefly as follows.

Transfer memory can occur due to the difference in the frequency dependence of impedance between a charge transfer layer (CTL), a surface protective layer (or an over coat layer (OCL)), and an undercoat layer (UCL), and the difference can increase with increasing use history.

However, the inventor has found that the frequency dependence of impedance is stable when the frequency of the AC voltage is 2 kHz or more. Consequently, the inventor has accomplished the present invention based on the finding that if electrostatic discharge is performed in such a way that the frequency of the AC voltage applied for electrostatic discharge is set at 2 kHz or more and increased depending on use history, the region where the frequency dependence of impedance is stable can be used in the image forming method so that the history of the image formed during the previous cycle can be successfully erased and thus transfer memory can be reduced.

Specifically, the object of the present invention can be achieved by the following means.

1. To achieve the abovementioned object, according to an aspect, an electrophotographic image forming method reflecting one aspect of the present invention comprises: performing a reversal development process using an electrophotographic photoreceptor including a conductive support, and an undercoat layer, a photosensitive layer, and a surface protective layer, which are at least provided on the conductive support, wherein the surface protective layer includes at least a cured resin and a component capable of influencing the frequency dependence of impedance, and the undercoat layer includes at least a metal oxide and has a thickness in the range of 1 to 30 μm; and performing an electrostatic discharge step including applying an AC voltage at 2 kHz or more, wherein the frequency of the AC voltage is increased depending on use history.

2. The electrophotographic image forming method according to Item. 1, wherein the component capable of influencing the frequency dependence of impedance is preferably fine particles including at least tin oxide, zinc oxide, titanium oxide, or aluminum oxide or fine particles including a fluororesin.

3. The electrophotographic image forming method according to Item. 1 or 2, wherein the cured resin is preferably a resin obtained by polymerization of a polymerizable monomer having at least an acryloyl or methacryloyl group in its molecule.

4. The electrophotographic image forming method according to any one of Items. 1 to 3, wherein the cured resin preferably includes fluororesin fine particles and a fluoroalkyl group-containing resin.

5. The electrophotographic image forming method according to any one of Items. 1 to 4, wherein the metal oxide contained in the undercoat layer is preferably in the form of fine particles including at least tin oxide, zinc oxide, titanium oxide, or aluminum oxide.

6. The electrophotographic image forming method according to any one of Items. 1 to 5, wherein the photosensitive layer preferably has a layer including at least a charge generation material, wherein the charge generation material includes at least Y-titanylphthalocyanine.

7. The electrophotographic image forming method according to any one of Items. 1 to 6, wherein in the electrostatic discharge step, a DC voltage with the same polarity as the polarity of electrostatic charge on the electrophotographic photoreceptor is preferably applied in addition to the AC voltage.

8. The electrophotographic image forming method according to any one of Items. 1 to 6, wherein in the electrostatic discharge step, light for electrostatic discharge is preferably applied simultaneously with the application of the AC voltage.

9. The electrophotographic image forming method according to Item. 7, wherein in the electrostatic discharge step, light for electrostatic discharge is preferably applied simultaneously with the application of the AC voltage and the DC voltage.

BRIEF DESCRIPTION OF THE DRAWINGS

The above and other objects, advantages and features of the present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Figure 1A:
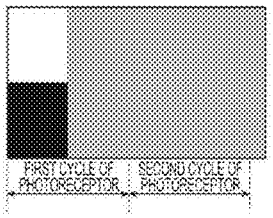
FIGS. 1A, 1B, 1C, 1D, and 1E are diagrams for explaining transfer memory.

Hereinafter, an embodiment of the present invention will be described with reference to the drawings. However, the scope of the invention is not limited to the illustrated examples.

An electrophotographic image forming method of an embodiment of the present invention includes performing a reversal development process using an electrophotographic photoreceptor including a conductive support, and an undercoat layer, a photosensitive layer, and a surface protective layer, which are at least provided on the conductive support, wherein the surface protective layer includes at least a cured resin and a component capable of influencing the frequency dependence of impedance, and the undercoat layer includes at least a metal oxide and has a thickness in the range of 1 to 30 μm; and performing an electrostatic discharge step including applying an AC voltage at 2 kHz or more, wherein the frequency of the AC voltage is increased depending on use history. This feature is a technical feature common to the aspects of the present invention recited in Items. 1 to 9.

In an embodiment of the present invention, the component capable of influencing the frequency dependence of impedance is preferably fine particles including at least tin oxide, zinc oxide, titanium oxide, or aluminum oxide or fine particles including a fluororesin, so that the component can improve the mechanical strength and reduce the skin friction resistance.

In addition, the cured resin is preferably a resin obtained by polymerization of a polymerizable monomer having at least an acryloyl or methacryloyl group in the molecule, so that it can increase the hardness of the surface protective layer.

In addition to the cured resin, the surface protective layer preferably includes fluororesin fine particles and a fluoroalkyl group-containing resin, so that the surface layer can have reduced frictional resistance.

In view of hole blocking properties and electron transport, the metal oxide contained in the undercoat layer is preferably in the form of fine particles including at least tin oxide, zinc oxide, titanium oxide, or aluminum oxide.

In the photosensitive layer having at least a charge generation material-containing layer, the charge generation material preferably includes Y-titanylphthalocyanine, which has particularly high sensitivity.

In the electrostatic discharge step, a DC voltage with the same polarity as the polarity of electrostatic charge on the electrophotographic photoreceptor is preferably applied in addition to the AC voltage, so that charges accumulated in the photoreceptor can be further discharged.

In the electrostatic discharge step, light for electrostatic discharge is also preferably applied simultaneously with the application of the AC voltage, so that charges accumulated in the photoreceptor can be further discharged.

In the electrostatic discharge step, light for electrostatic discharge is also preferably applied simultaneously with the application of the AC voltage and the DC voltage, so that charges accumulated in the photoreceptor can be further discharged.

Hereinafter, the elements of the present invention and embodiments and modes for carrying out the present invention will be described in detail. As used herein, the word to means to include the values before and after it as the lower and upper limits.

<<Electrophotographic Image Forming Method>>

The electrophotographic image forming method of an embodiment of the present invention includes performing a reversal development process using an electrophotographic photoreceptor including a conductive support, and an undercoat layer, a photosensitive layer, and a surface protective layer, which are at least provided on the conductive support, wherein the surface protective layer includes at least a cured resin and a component capable of influencing the frequency dependence of impedance, and the undercoat layer includes at least a metal oxide and has a thickness in the range of 1 to 30 μm; and performing an electrostatic discharge step including applying an AC voltage at 2 kHz or more, wherein the frequency of the AC voltage is increased depending on use history.

The electrophotographic image forming method of an embodiment of the present invention is preferably employed in an electrophotographic image forming method including at least the steps of: charging the surface of an electrophotographic photoreceptor; exposing the surface of the electrophotographic photoreceptor to light to form an electrostatic latent image; developing the electrostatic latent image with toner to form a toner image; transferring the toner image onto a transfer medium; and removing static electricity from the electrophotographic photoreceptor.

The electrophotographic image forming method of an embodiment of the present invention can be used, for example, as a monochrome image forming method or a full-color image forming method. The full-color image forming method may be of any type, such as a four cycle type image forming method using one photoreceptor and developing apparatuses for four colors: yellow, magenta, cyan, and black or a tandem type image forming method using image forming units that are each installed for each color and each include a photoreceptor and a developing apparatus for each color.

A specific example of the electrophotographic image forming method of an embodiment of the present invention may be the following method.

Using the electrophotographic photoreceptor (hereinafter also simply referred to as the "photoreceptor") according to an embodiment of the present invention, the surface of the photoreceptor is charged by means of an electrostatic charger (the charging step). After the charging step, the surface of the electrophotographic photoreceptor is exposed to light so that an electrostatic latent image is formed (the exposure step). The electrostatic latent image is developed using a developing apparatus, so that a toner image is formed (the developing step). The toner image is transferred onto a transfer medium such as a copy sheet or a transfer belt. After the transfer step, the electrostatic discharge step according to an embodiment of the present invention is performed, after which the next image forming cycle is performed. After transferred onto a transfer medium such as a transfer belt, the toner image is transferred onto a copy sheet and then fixed on the copy sheet by a fixing process such as a contact heating process (the fixing step), so that a visible image is obtained. After the transfer step, the toner remaining on the photoreceptor (the toner residue after the transfer) is removed with a rubber blade or other means (the cleaning step). The cleaning step may be performed before or after the electrostatic discharge step. When the electrostatic discharge step includes light irradiation, the cleaning step is preferably performed after the electrostatic discharge step. In this case, the toner residue is removed from the photoreceptor before it absorbs light for electrostatic discharge, which makes possible efficient electrostatic discharge.

<Electrostatic Discharge Step>

In an embodiment of the present invention, the step of performing electrostatic discharge on the electrophotographic photoreceptor includes applying an AC voltage at 2 kHz or more, wherein the frequency of the AC voltage is increased depending on use history, when static electricity is removed.

In the electrostatic discharge step, a DC voltage with the same polarity as the polarity of electrostatic charge on the electrophotographic photoreceptor is preferably applied in addition to the AC voltage, so that charges accumulated in the photoreceptor can be further discharged.

In the electrostatic discharge step, light for electrostatic discharge is also preferably applied simultaneously with the application of the AC voltage, so that charges accumulated in the photoreceptor can be further discharged.

In the electrostatic discharge step, light for electrostatic discharge is also preferably applied simultaneously with the application of the AC voltage and the DC voltage, so that charges accumulated in the photoreceptor can be further discharged.

(Static Discharger)

In the electrostatic discharge step, the method of applying the AC voltage is not restricted and may be a known method. For example, a non-contact type static discharger such as a corona discharger may be provided and connected to an external high-voltage power source so that any AC frequency can be applied.

A contact type static discharger may also be used, such as a charging roller or a charging brush. In view of discharging stability, however, the non-contact type is preferred.

(Use History)

In an embodiment of the present invention, for example, the use history is specifically, but not limited to, the number of printed sheets.

Figure 3:
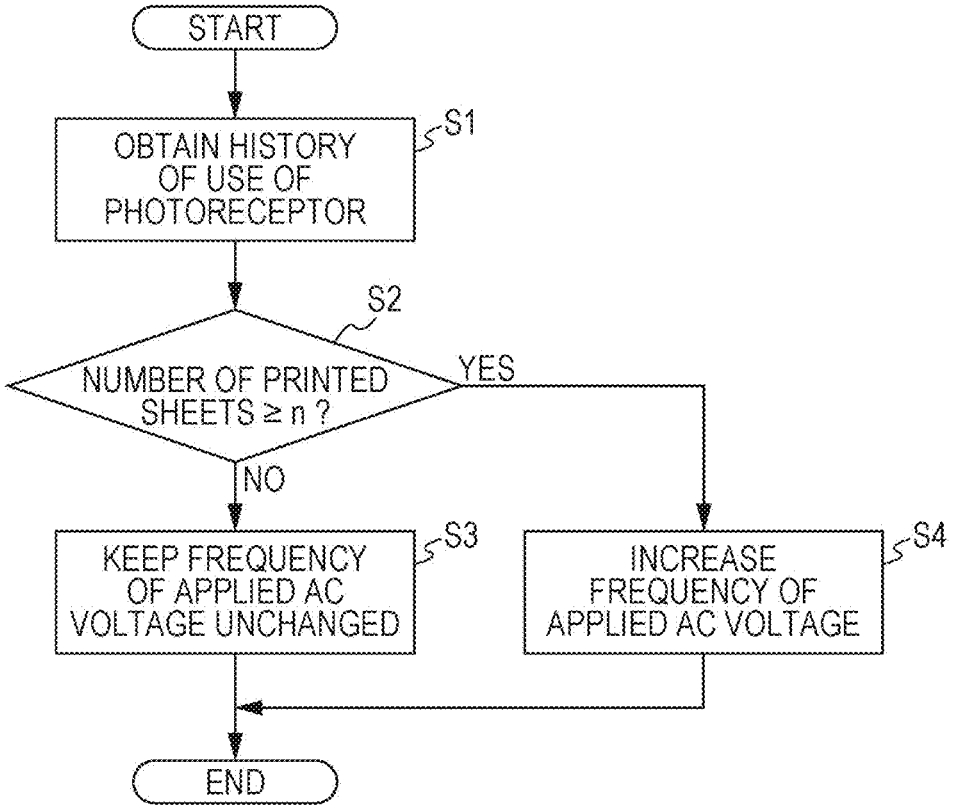
FIG. 3 is a flow chart showing an example of the step of increasing AC frequency depending on the use history of photoreceptor.

The step of increasing the frequency of the AC voltage depending on the use history of the electrophotographic photoreceptor will be described with reference to the flow chart shown in FIG. 3.

The electrophotographic image forming method is performed using an electrophotographic image forming apparatus having a storage unit configured to store the use history. First, the use history of the electrophotographic photoreceptor (photoreceptor) is obtained from the storage unit (S1), which stores the history. It is determined whether the use history (the number of printed sheets) is n or more (S2). If the number of printed sheets on which images are formed is less than n, the frequency of the applied AC voltage is kept unchanged (S3). If the number of printed sheets on which images are formed is n or more, the frequency of the applied AC voltage is increased (S4).

In this way, the frequency of the applied AC voltage is successfully increased when the use history (the number of printed sheets on which images are formed) of the photoreceptor is heavy (large), so that the previous cycle image history can be successfully prevented from appearing.

The frequency of the applied AC voltage may be increased in any way. For example, electrostatic discharge may be performed at a constant frequency until the number of printed sheets reaches 10,000, and when the number of printed sheets exceeds 10,000, the frequency may be increased from the constant value, which may be followed by electrostatic discharge at the increased frequency. Alternatively, the frequency may be increased stepwise depending on the use history (for example, the frequency may be increased every 100,000 printed sheets).

The level of the increase in the frequency of the applied AC voltage may be constant or varied depending on the use history.

As a non-limiting example, the storage unit specifically includes a read only memory (ROM) and a random access memory (RAM) (both not shown) and other components.

(DC Voltage)

In the electrostatic discharge step, a DC voltage with the same polarity as the polarity of electrostatic charge on the electrophotographic photoreceptor is preferably applied in addition to the AC voltage.

The method of applying the DC voltage is not restricted and may be a known method. For example, a DC voltage may be applied in such a way that similarly to the method of applying the AC voltage, a non-contact type static discharger such as a corona discharger is provided and connected to an external high-voltage power source and a DC bias is applied and superimposed on any AC frequency.

(Light for Electrostatic Discharge)

In the electrostatic discharge step, light electrostatic discharge that includes applying light for electrostatic discharge is preferably performed in addition to the alternating current electrostatic discharge (AC electrostatic discharge), so that charges accumulated in the photoreceptor can be further discharged by means of light.

The light for electrostatic discharge is preferably applied simultaneously with the application of the AC voltage or the application of the AC voltage and the DC voltage.

The light for use in the light electrostatic discharge preferably includes light with a wavelength of 500 to 900 nm.

The source of the light for electrostatic discharge may be of any type satisfying these conditions. A known light source may be used as the source of the light for electrostatic discharge. An optical filter or other means may be used to remove light in the unnecessary wavelength region, so that only light in a preferred wavelength region can be applied.

<<Structure of Electrophotographic Photoreceptor>>

The electrophotographic photoreceptor according to an embodiment of the present invention has at least an undercoat layer, a photosensitive layer, and a surface protective layer, which are provided on a conductive support, wherein the surface protective layer includes at least a cured resin and a component capable of influencing the frequency dependence of impedance, and the undercoat layer includes at least a metal oxide and has a thickness in the range of 1 to 30 μm.

The layered structure of the photoreceptor according to an embodiment of the present invention has at least a photosensitive layer and a surface protective layer on a conductive support.

The photosensitive layer has both the function of absorbing light to generate charges and the function of transporting charges. The photosensitive layer may have a monolayer structure including a charge generation material and a charge transport material. Alternatively, the photosensitive layer may have a multilayer structure of a charge generation layer including a charge generation material and a charge transport layer including a charge transport material. An undercoat layer is provided between the conductive support and the photosensitive layer. The photosensitive layer may have any structure. Specific examples of layered structures including the surface protective layer include, for example, the following:

(1) A layered structure including an undercoat layer, a charge generation layer, a charge transport layer, and a surface protective layer, which are stacked in order on the conductive support; and (2) A layered structure including an undercoat layer, a single layer including a charge transport material and a charge generation material, and a surface protective layer, which are stacked in order on the conductive support.

In an embodiment of the present invention, the photoreceptor may have any of the layered structure (1) or (2). Among them, the layered structure obtained by sequentially forming an undercoat layer, a charge generation layer, a charge transport layer, and a surface protective layer on the conductive support is particularly preferred.

Figure 4:
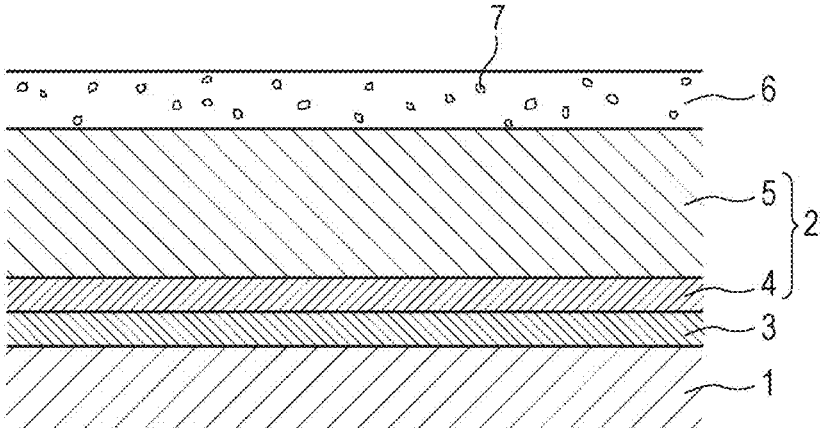
FIG. 4 is a schematic diagram showing an example of the layered structure of an electrophotographic photoreceptor according to an embodiment of the present invention.

FIG. 4 is a schematic diagram showing an example of the layered structure of the photoreceptor according to an embodiment of the present invention. In FIG. 4, a reference numeral 1 represents a conductive support, a reference numeral 2 represents a photosensitive layer, a reference numeral 3 represents an undercoat layer, a reference numeral 4 represents a charge generation layer, a reference numeral 5 represents a charge transport layer, a reference numeral 6 represents a surface protective layer, and a reference numeral 7 represents a component capable of influencing the frequency dependence of impedance.

Next, the features of the surface protective layer, the conductive support, the undercoat layer, and the photosensitive layer (the charge generation layer and the charge transport layer) constituting the photoreceptor according to an embodiment of the present invention will be described one by one.

<<Surface Protective Layer>>

The surface protective layer includes at least a cured resin and a component capable of influencing the frequency independence of impedance.

The cured resin is a resin obtained by polymerizing at least a crosslinking polymerizable compound as described below.

Examples of the component capable of influencing the frequency dependence of impedance include the materials described below, such as metal oxide fine particles.

[Cured Resin]

In an embodiment of the present invention, the cured resin is contained as a binder resin in the surface protective layer. The cured resin refers to a resin obtained by polymerization of a crosslinking polymerizable compound or compounds. In an embodiment of the present invention, the cured resin, which will be described in detail below, is preferably a resin obtained by polymerization of a polymerizable monomer having at least an acryloyl or methacryloyl group. Other crosslinking polymerizable compounds that may also be used include a guanamine compound and a melamine compound.

In an embodiment of the present invention, the resin obtained by polymerization of a crosslinking polymerizable compound may also be used in combination with a known resin such as a polyester resin, a polycarbonate resin, a polyurethane resin, or a silicone resin.

<Crosslinking Polymerizable Compound>

The crosslinking polymerizable compound, which can be used to form the surface protective layer according to an embodiment of the present invention, may be a radically polymerizable compound having two or more radically polymerizable reactive groups. The radically polymerizable compound is preferably a radically polymerizable monomer having at least one of an acryloyl group or a methacryloyl group as a radically polymerizable reactive group.

Examples of these radically polymerizable monomers include the compounds shown below, although it will be understood that the radically polymerizable monomers that can be used in an embodiment of the present invention are not limited to these compounds.

[Chemical Formula 1]

M1

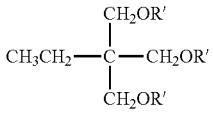

M2

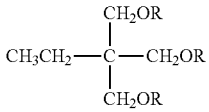

M3

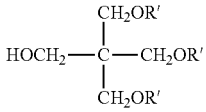

M4

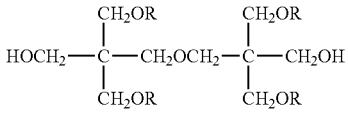

M5

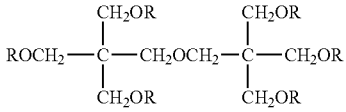

-continued

M6 $CH_3CH_2C—(CH_2OC_3H_6OR)_3$

M7 $CH_3CH_2C—(CH_2CH_2OR)_3$

[Chemical Formula 2]

M8 $R—(OC_3H_6)_3—OR$

M9 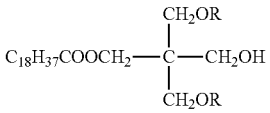

M10 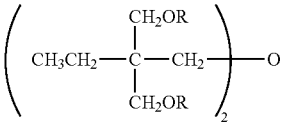

M11 $(ROCH_2)_4—C$

M12 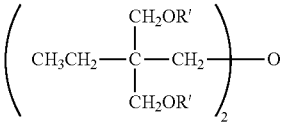

M13 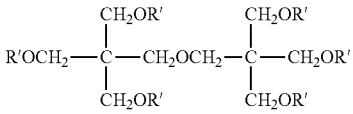

M14 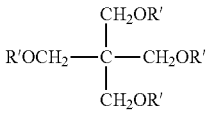

M15 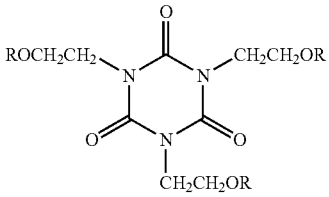

These radically polymerizable monomers are known and available as commercial products.

In the formulae, R represents the acryloyl group shown below, and R' represents the methacryloyl group shown below.

[Chemical Formula 3]

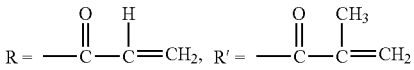

Specifically, the guanamine compound that can be used in an embodiment of the present invention is, for example, a compound having a structure represented by formula (A) below.

[Chemical Formula 4]

(A)

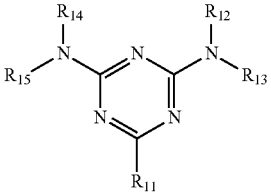

In formula (A), $R_{11}$ represents an optionally branched alkyl group of 1 to 10 carbon atoms or a substituted or unsubstituted phenyl group of 6 to 10 carbon atoms. $R_{12}$, $R_{13}$, $R_{14}$, and $R_{15}$ each independently represent hydrogen, $—CH_2—OH$, or $—CH_2—O—R_{16}$. $R_{16}$ represents an optionally branched alkyl group of 1 to 5 carbon atoms.

Specifically, the melamine compound that can be used in an embodiment of the present invention is, for example, a compound having a structure represented by formula (B) below.

[Chemical Formula 5]

(B)

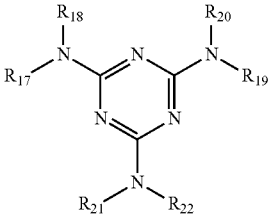

In formula (B), $R_{17}$, $R_{18}$, $R_{19}$, $R_{20}$, $R_{21}$, and $R_{22}$ each independently represent hydrogen, $—CH_2—OH$, or $—CH_2—O—R_{23}$. $R_{23}$ represents an optionally branched alkyl group of 1 to 5 carbon atoms.

<Component Capable of Influencing the Frequency Dependence of Impedance>

In an embodiment of the present invention, the surface protective layer may include a cured resin containing metal oxide fine particles or fluororesin fine particles in order to significantly improve the mechanical strength of the photoreceptor or reduce the surface resistance (friction) of the photoreceptor.

It should be noted that the metal oxide fine particles and the fluororesin fine particles correspond to the component capable of influencing the frequency dependence of impedance. The addition of such fine particles can make transfer memory more likely to occur. However, the image forming method of an embodiment of the present invention makes it possible to reduce transfer memory even when the surface protective layer contains such fine particles.

As used herein, the term "capable of influencing the frequency dependence of impedance" can also refer to "having the ability to reduce the impedance particularly in a low-frequency region."

<Metal Oxide Fine Particles>

The component capable of influencing the frequency dependence of impedance as mentioned above may be, for example, metal oxide fine particles. Specifically, the component capable of influencing the frequency dependence of impedance may be fine particles including at least tin oxide, zinc oxide, titanium oxide, or aluminum oxide or fine particles including a fluororesin. The metal oxide fine particles (the component capable of influencing the frequency dependence of impedance) preferably have a number average primary particle size in the range of 1 to 300 nm. In particular, the number average primary particle size is preferably in the range of 3 to 100 nm.

(Method for Measuring the Number Average Primary Particle Size of Metal Oxide Fine Particles)

The number average primary particle size of the metal oxide fine particles can be determined as follows. A photograph of the metal oxide fine particles is taken at a magnification of 10,000 times with a scanning electron microscope JSM-7401F (manufactured by JEOL Ltd.). The photographic images of randomly selected 300 particles (exclusive of agglomerated particles) are input into a scanner and then subjected to binarization using an automatic image analyzing system LUZEX (registered trademark) AP (manufactured by NIRECO CORPORATION) with Software Version 1.32, in which the individual horizontal Feret diameters are calculated. The average of the Feret diameters is calculated as the number average primary particle size. As used herein, the term "horizontal Feret diameter" refers to the length of a side (parallel to the x-axis) of a circumscribed rectangle obtained by the binarization of the image of a metal oxide fine particle.

(Surface-Modified Metal Oxide Fine Particles)

In an embodiment of the present invention, the metal oxide fine particles to be added to the surface protective layer may be modified with a coupling agent, and more specifically may be surface-modified with a coupling agent having a reactive organic group.

(Coupling Agent)

The metal oxide fine particles to be added to the surface protective layer may be surface-modified with a coupling agent capable of reacting with hydroxy groups or other groups present on the surface of the metal oxide fine particles. Such a coupling agent may be a silane coupling agent or a titanium coupling agent. In an embodiment of the present invention, a coupling agent having a reactive organic group may be used in order to further increase the hardness of the surface protective layer. A coupling agent having a radically polymerizable reactive group may be used as the coupling agent having a reactive organic group. Such a radially polymerizable reactive group can also react with the crosslinking polymerizable compound according to an embodiment of the present invention to form a strong protective film. The coupling agent having a radically polymerizable reactive group is preferably a silane coupling agent having a radically polymerizable reactive group such as a vinyl, acryloyl, or methacryloyl group. Examples of such a silane coupling agent having a radically polymerizable reactive group include known compounds as shown below.

S-1: $CH_2{=}CHSi(CH_3)(OCH_3)_2$
S-2: $CH_2{=}CHSi(OCH_3)_3$
S-3: $CH_2{=}CHSiCl_3$
S-4: $CH_2{=}CHCOO(CH_2)_2Si(CH_3)(OCH_3)_2$
S-5: $CH_2{=}CHCOO(CH_2)_2Si(OCH_3)_3$
S-6: $CH_2{=}CHCOO(CH_2)_2Si(OC_2H_5)(OCH_3)_2$
S-7: $CH_2{=}CHCOO(CH_2)_3Si(OCH_3)_3$
S-8: $CH_2{=}CHCOO(CH_2)_2Si(CH_3)\ Cl_2$
S-9: $CH_2{=}CHCOO(CH_2)_2SiCl_3$
S-10: $CH_2{=}CHCOO(CH_2)_3Si(CH_3)\ Cl_2$
S-11: $CH_2{=}CHCOO(CH_2)_3SiCl_3$
S-12: $CH_2{=}C(CH_3)COO(CH_2)_2Si(CH_3)(OCH_3)_2$
S-13: $CH_2{=}C(CH_3)COO(CH_2)_2Si(OCH_3)_3$
S-14: $CH_2{=}C(CH_3)COO(CH_2)_3Si(CH_3)(OCH_3)_2$
S-15: $CH_2{=}C(CH_3)COO(CH_2)_3Si(OCH_3)_3$
S-16: $CH_2{=}C(CH_3)COO(CH_2)_2Si(CH_3)\ Cl_2$
S-17: $CH_2{=}C(CH_3)COO(CH_2)_2SiCl_3$
S-18: $CH_2{=}C(CH_3)COO(CH_2)_3Si(CH_3)\ Cl_2$
S-19: $CH_2{=}C(CH_3)COO(CH_2)_3SiCl_3$
S-20: $CH_2{=}CHSi(C_2H_5)(OCH_3)_2$
S-21: $CH_2{=}C(CH_3)Si(OCH_3)_3$
S-22: $CH_2{=}C(CH_3)Si(OC_2H_5)_3$
S-23: $CH_2{=}CHSi(OCH_3)_3$
S-24: $CH_2{=}C(CH_3)Si(CH_3)(OCH_3)_2$
S-25: $CH_2{=}CHSi(CH_3)Cl_2$
S-26: $CH_2{=}CHCOOSi(OCH_3)_3$
S-27: $CH_2{=}CHCOOSi(OC_2H_5)_3$
S-28: $CH_2{=}C(CH_3)COOSi(OCH_3)_3$
S-29: $CH_2{=}C(CH_3)COOSi(OC_2H_5)_3$
S-30: $CH_2{=}C(CH_3)COO(CH_2)_3Si(OC_2H_5)_3$
S-31: $CH_2{=}CHCOO(CH_2)_2Si(CH_3)_2\ (OCH_3)$
S-32: $CH_2{=}CHCOO(CH_2)_2Si(CH_3)(OCOCH_3)_2$
S-33: $CH_2{=}CHCOO(CH_2)_2Si(CH_3)(ONHCH_3)_2$
S-34: $CH_2{=}CHCOO(CH_2)_2Si(CH_3)(OC_6H_5)_2$
S-35: $CH_2{=}CHCOO(CH_2)_2Si(C_{10}H_{21})(OCH_3)_2$
S-36: $CH_2{=}CHCOO(CH_2)_2Si(CH_2C_6H_5)(OCH_3)_2$

Besides S-1 to S-36 shown above, the silane coupling agent may also be a silane compound having a radically polymerizable reactive organic group. These silane coupling agents may be used alone or in a mixture of two or more.

(Method for Preparing Surface-Modified Metal Oxide Fine Particles)

In the surface modification process, 100 parts by mass of metal oxide fine particles are preferably surface-modified with 0.1 to 100 parts by mass of a coupling agent in 50 to 5,000 parts by mass of a solvent using a wet-type media disperser. Alternatively, the surface modification may also be performed by a dry process.

Hereinafter, a description will be given of a surface modification method for producing metal oxide fine particles uniformly surface-modified with a coupling agent.

Specifically, a slurry containing metal oxide fine particles and a coupling agent (a suspension of solid particles) is subjected to wet grinding so that the metal oxide fine particles are made finer while being surface-modified. The product is then turned into a powder by removing the solvent, so that metal oxide fine particles uniformly surface-modified with the coupling agent are successfully obtained.

In an embodiment of the present invention, the wet-type media disperser is used as a surface modifying apparatus. The wet-type media disperser has a vessel containing beads as media and equipped with a stirring disk vertical to the rotation axis and is configured to perform the process of grinding and dispersing agglomerated particles of metal oxide fine particles by rotating the stirring disk at high speed. The disperser may be of any type that allows metal oxide fine particles to be dispersed sufficiently and surface-modified in the process of surface-modifying the metal oxide fine particles. Various types of disperses may be used, such as vertical and horizontal disperses and continuous and batch dispersers. Specifically, the disperser to be used may be a sand mill, Ultravisco Mill, a pearl mill, a grain mill, Dyno Mill, an agitator mill, a dynamic mill, or the like. In these dispersers, fine grinding and dispersing are achieved by impact breakdown, friction, shearing, shearing stress, and other effects using grinding media such as balls or beads.

Balls made of glass, alumina, zircon, zirconia, steel, or flint rock can be used as the beads in the wet-type media disperser. Zirconia or zircon beads are particularly preferred. Concerning the size of the beads, those with a diameter of about 1 to about 2 mm are generally used. In an embodiment of the present invention, however, those with a diameter of about 0.1 to about 1.0 mm are preferably used.

The disk and the inner wall of the vessel used in the wet-type media disperser may be made of various materials such as stainless steel, nylon, and ceramics. Particularly in an embodiment of the present invention, the disk and the inner wall of the vessel are preferably made of a ceramic such as zirconia or silicon carbide.

The wet process described above makes it possible to obtain metal oxide fine particles surface-modified with a coupling agent. In order to improve the wear resistance of the surface protective layer, 30 to 250 parts by mass of the surface-modified metal oxide fine particles are preferably added to 100 parts by mass of the crosslinking polymerizable compound.

<Fluororesin Fine Particles and Fluoroalkyl Group-Containing Resin>

Fluororesin fine particles and a fluoroalkyl group-containing resin may also be added to the cured resin.

(Fluororesin Fine Particles)

Common fluororesin fine particles may be used. As a specific example of the fluororesin, one or more is preferably selected as appropriate from tetrafluoroethylene resin, trifluorochloroethylene resin, hexafluorochloroethylene-propylene resin, vinyl fluoride resin, vinylidene fluoride resin, difluorodichloroethylene resin, and any copolymers thereof. In particular, tetrafluoroethylene resin (hereinafter also referred to as "polytetrafluoroethylene" or "PTFE") and vinylidene fluoride resin (PVdF) are preferred.

(Fluoroalkyl Group-Containing Resin)

A known fluoroalkyl group-containing resin may be used, examples of which include resin fine particles and resins having at least repeating units represented by structural formulae A and B below, respectively.

[Chemical Formula 6]

Structural Formula A

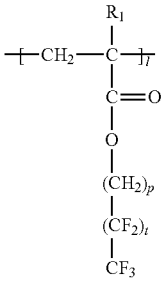

-continued

Structural Formula B

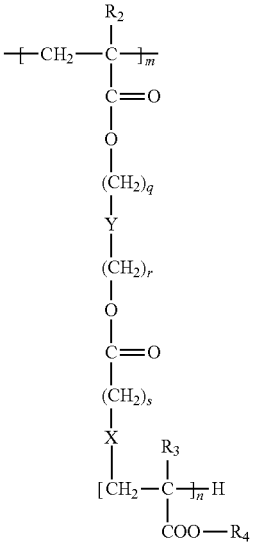

In structural formulae A and B, l, m, and n each represent an integer of 1 or more, p, q, r, ands each represent an integer of 0, 1, or more, t represents an integer of 8 or more, $R_1$, $R_2$, $R_3$, and $R_4$ each represent a hydrogen atom or an alkyl group, X represents an alkylene chain, a halogen-substituted alkylene chain, —S—, —O—, —NH—, or a single bond, and Y represents an alkylene chain, a halogen-substituted alkylene chain, $(C_zH_{2z-1}(OH))$—, or a single bond, and z represents an integer of 1 or more.

In structural formula A, t is preferably 5 to 8.

Specifically, commercially available examples of the fluoroalkyl group-containing resin including at least the repeating units represented by structural formulae A and B include GF300 and GF400 (manufactured by Toagosei Co., Ltd.).

Besides these materials, an optional material such as an antioxidant may be added to the surface protective layer according to an embodiment of the present invention, when it is formed.

<Formation of Surface Protective Layer>

The surface protective layer can be formed by a process that includes preparing a coating liquid by adding, to a solvent, the crosslinking polymerizable compound and the surface-modified metal oxide fine particles and optionally the charge transport material described below, any other resin, a polymerization initiator, lubricant particles, an antioxidant, and other materials; applying the coating liquid to the surface of the photosensitive layer by a known method; subjecting the coating to air drying or drying by heating; and then curing the dried coating. The surface protective layer preferably has a thickness of 0.2 to 10 μm, more preferably 0.5 to 6 μm.

<Polymerization Initiator>

The crosslinking polymerizable compound, which can be used to form the surface protective layer according to an embodiment of the present invention, is subjected to a polymerization reaction, which can be performed by a method using electron beam cleavage reaction or by a method using light or heat in the presence of a radical polymerization initiator. When the polymerization reaction is performed using a radical polymerization initiator, any of a photopolymerization initiator and a thermal polymerization initiator may be used as the polymerization initiator.

Both a photopolymerization initiator and a thermal polymerization initiator may also be used together.

The polymerization initiator for use in the formation of the surface protective layer according to an embodiment of the present invention may be a thermal polymerization initiator, examples of which include azo compounds such as 2,2'-azobisisobutyronitrile, 2,2'-azobis(2, 4-dimethylazobisvaleronitrile), and 2,2'-azobis(2-methylbutyronitrile); and peroxides such as benzoyl peroxide (BPO), di-tert-butyl hydroperoxide, tert-butyl hydroperoxide, chlorobenzoyl peroxide, dichlorobenzoyl peroxide, bromomethylbenzoyl peroxide, and lauroyl peroxide.

Examples of the photopolymerization initiator include acetophenone or ketal photopolymerization initiators such as diethoxyacetophenone, 2,2-dimethoxy-1,2-diphenylethan-1-one, 1-hydroxy-cyclohexyl-phenyl-ketone, 4-(2-hydroxyethoxy)phenyl-(2-hydroxy-2-propyl)ketone, 2-benzyl-2-dimethylamino-1-(4-morpholinophenyl)butanone-1 (IRGACURE 369 manufactured by BASF Japan Ltd.), 2-hydroxy-2-methyl-1-phenylpropan-1-one, 2-methyl-2-morpholino(4-methylthiophenyl)propan-1-one, and 1-phenyl-1,2-propanedione-2-(o-ethoxycarbonyl)oxime; ether photopolymerization initiators such as benzoin, benzoin methyl ether, benzoin ethyl ether, benzoin isobutyl ether, and benzoin isopropyl ether; benzophenone photopolymerization initiators such as benzophenone, 4-hydroxybenzophenone, methyl o-benzoylbenzoate, 2-benzoylnaphthalene, 4-benzoylbiphenyl, 4-benzoyl phenyl ether, acrylated benzophenone, and 1,4-benzoylbenzene; and thioxanthone photopolymerization initiators such as 2-isopropylthioxanthone, 2-chlorothioxanthone, 2,4-dimethylthioxanthone, 2,4-diethylthioxanthone, and 2,4-dichlorothioxanthone.

Other examples of the photopolymerization initiator include ethylanthraquinone, 2,4,6-trimethylbenzoyl diphenylphosphine oxide, 2,4,6-trimethylbenzoyl phenylethoxyphosphine oxide, bis(2,4,6-trimethylbenzoyl)phenylphosphine oxide (IRGACURE 819 manufactured by BASF Japan Ltd.), bis(2,4-dimethoxybenzoyl)-2, 4, 4-trimethylpentylphosphine oxide, methylphenylglyoxyester, 9,10-phenanthrene, acridine compounds, triazine compounds, and imidazole compounds. A compound having a photopolymerization-promoting effect may also be used alone or in combination with any of the above photopolymerization initiators. Examples of such a compound include triethanolamine, methyldiethanolamine, ethyl 4-dimethylaminobenzoate, isoamyl 4-dimethylaminobenzoate, (2-dimethylamino)ethyl benzoate, and 4,4'-dimethylaminobenzophenone.

The polymerization initiator for use in the formation of the surface protective layer according an embodiment of the present invention is preferably a photopolymerization initiator, more preferably any of an alkylphenone compound and a phosphine oxide compound, even more preferably an initiator having an α-hydroxyacetophenone structure or an acylphosphine oxide structure.

These polymerization initiators may be used alone or in a mixture of two or more. The content of the polymerization initiator may be 0.1 to 40 parts by mass, preferably 0.5 to 20 parts by mass, based on 100 parts by mass of the crosslinking polymerizable compound.

<Solvent>

Examples of the solvent for use in the formation of the surface protective layer include, but are not limited to, methanol, ethanol, 1-propanol, 2-propanol, 1-butanol, 2-butanol, 2-methyl-2-propanol, benzyl alcohol, methyl isopropyl ketone, methyl isobutyl ketone, methyl ethyl ketone, cyclohexane, toluene, xylene, methylene chloride, ethyl acetate, butyl acetate, 2-methoxyethanol, 2-ethoxyethanol, tetrahydrofuran, 1,4-dioxane, 1,3-dioxolane, pyridine, and diethylamine.

<Polymerization Reaction for Surface Protective Layer>

In an embodiment of the present invention, the polymerization reaction process for forming the surface protective layer preferably includes applying active rays to the coating film to generate radicals and thus to polymerize the components of the coating film; and performing intermolecular and intramolecular crosslinking reactions to form crosslinks so that the polymerized components are cured to form a cured resin. The active rays are preferably light beams such as ultraviolet or visible rays or electron beams. Ultraviolet rays are particularly preferred in view of ease of use.

Any ultraviolet light source capable of emitting ultraviolet rays may be used. The light source may be, for example, a low pressure mercury lamp, a medium pressure mercury lamp, a high pressure mercury lamp, an ultrahigh pressure mercury lamp, a carbon arc lamp, a metal halide lamp, a xenon lamp, a flash (pulse) xenon lamp, or an ultraviolet LED. Although the irradiation conditions vary from lamp to lamp, the active ray exposure dose is generally 1 to 20 $mJ/cm^2$, preferably 5 to 15 $mJ/cm^2$. The output voltage of the light source is preferably 0.1 to 5 kW, more preferably 0.5 to 3 kW.

The electron beam source may be any electron beam irradiator. In general, a curtain beam type electron beam accelerator, which can provide high power at a relatively low cost, is effectively used for electron beam irradiation. The acceleration voltage for electron beam irradiation is preferably 100 to 300 kV. The absorbed dose is preferably 0.005 Gy to 100 kGy (0.5 rad to 10 Mrad).

The active ray exposure time is the time required to obtain the necessary active ray dose. Specifically, the active ray exposure time should preferably be 0.1 seconds to 10 minutes, more preferably 1 second to 5 minutes, in view of polymerization efficiency or operating efficiency.

In an embodiment of the present invention, the surface protective layer may be dried before, during, or after the active ray irradiation. The timing of the drying may be appropriately selected in combination with the active ray irradiation conditions. The conditions for drying the surface protective layer may be appropriately selected depending on the type of the solvent used in the coating liquid, the thickness of the surface protective layer, and other conditions. The drying temperature is preferably room temperature to 180° C., more preferably 80 to 140° C. The drying time is preferably 1 to 200 minutes, more preferably 5 to 100 minutes. In an embodiment of the present invention, when the surface protective layer is dried under the above conditions, the content of the solvent contained in the surface protective layer can be controlled within the range of 20 ppm to 75 ppm.

The surface protective layer formed on the photosensitive layer as described above can increase the hardness of the surface of the photoreceptor and improve the wear resistance and durability of the photoreceptor.

<<Conductive Support>>

In an embodiment of the present invention, the support used to form the photoreceptor may be any material having electrical conductivity, such as a product obtained by forming a metal such as aluminum, copper, chromium, nickel, zinc, or stainless steel into a drum or sheet, a product obtained by laminating a plastic film with a metal foil such as an aluminum or copper foil, a product obtained by vapor-depositing aluminum, indium oxide, or tin oxide on a plastic film, or a metal or plastic film or a paper sheet provided with a conductive layer formed by applying a conductive material alone or a mixture of a conductive material and a binder resin.

<<Undercoat Layer>>

In an embodiment of the present invention, the photoreceptor has an undercoat layer that is provided between the conductive support and the photosensitive layer and has a barrier function and an adhesive function. The undercoat layer can be formed by, for example, dipping in or coating with a solution of a binder resin such as casein, polyvinyl alcohol, nitrocellulose, ethylene-acrylic acid copolymer, polyamide, polyurethane, or gelatin in a known solvent. In particular, an alcohol-soluble polyamide resin is preferred among the binder resins.

The undercoat layer also contains at least a metal oxide for the control of resistance. Also for the control of resistance, the undercoat layer may also contain inorganic fine particles such as any of various types of conductive fine particles. Examples of the metal oxide include various metal oxides such as alumina, zinc oxide, titanium oxide, tin oxide, antimony oxide, indium oxide, and bismuth oxide. Ultrafine particles of tin-doped indium oxide, antimony-doped tin oxide, zirconium oxide, or the like may also be used. One or more types of these metal oxides may be used alone or in a mixture. A mixture of two or more types may be in the form of a solid solution or a fusion. The undercoat layer preferably contains the metal oxide in the form of fine particles. In this case, the fine particles preferably have a number average primary particle size of 0.3 μm or less, more preferably 0.1 μm or less.

The solvent for use in the formation of the undercoat layer is preferably one in which the conductive fine particles and fine particles of an inorganic material such as a metal oxide are well dispersible and in which a binder resin such as a polyamide resin is soluble. Specifically, alcohols of 2 to 4 carbon atoms, such as ethanol, n-propyl alcohol, isopropyl alcohol, n-butanol, tert-butanol, and sec-butanol are preferred because a polyamide resin, which is preferred as a binder resin, can have high solubility and high coating ability in them. In order to improve storage stability and the dispersibility of the inorganic fine particles, a co-solvent as shown below may be used in combination with the solvent. Examples of such a co-solvent that can produce an advantageous effect include methanol, benzyl alcohol, toluene, cyclohexanone, and tetrahydrofuran.

When the coating liquid is formed, the concentration of the binder resin may be appropriately selected depending on the thickness of the undercoat layer and the coating method. When the inorganic fine particles are dispersed, the mixing ratio of the inorganic fine particles to the binder resin is preferably 20 to 400 parts by mass, more preferably 50 to 200 parts by mass of the inorganic fine particles to 100 parts by mass of the binder resin.

Examples of the means for dispersing the inorganic fine particles include, but are not limited to, an ultrasonic disperser, a ball mill, a sand grinder, and a homomixer.

The method for drying the undercoat layer may be appropriately selected from known drying methods depending on the solvent type and the thickness of the layer to be formed. In particular, thermal drying is preferred.

In an embodiment of the present invention, the undercoat layer preferably has a thickness in the range of 1 to 30 μm, preferably 0.1 to 15 μm, more preferably 0.3 to 10 μm.

<<Photosensitive Layer>>

As mentioned above, the photosensitive layer constituting the photoreceptor according to an embodiment of the present invention may have a monolayer structure in which a charge generating function and a charge transporting function are provided by a single layer. More preferably, the photosensitive layer has a layered structure in which the functions of the photosensitive layer are separated into a charge generation layer (CGL) and a charge transport layer (CTL). Such a function separation type layered structure is advantageous not only in that an increase in residual potential associated with repeated use can be controlled to a low level, but also in that various electrophotographic characteristics can be easily controlled depending on the purpose. A negatively chargeable photoreceptor has a structure in which the charge generation layer (CGL) is provided on the undercoat layer and the charge transport layer (CTL) is provided on the CGL. A positively chargeable photoreceptor has a structure in which the charge transport layer (CTL) is provided on the undercoat layer and the charge generation layer (CGL) is provided on the CTL. The photosensitive layer has a preferred layered structure in the negatively chargeable photoreceptor having a structure with separate functions.

Hereinafter, each layer of the photosensitive layer in the function separation type negatively chargeable photoreceptor will be described for an example of the photosensitive layer.

<Charge Generation Layer>

The electrophotographic photoreceptor according to an embodiment of the present invention preferably has a charge generation layer as a layer including at least a charge generation material. Preferably, the charge generation layer includes a charge generation material (CGM) and a binder resin and is formed by applying a coating liquid containing a charge generation material dispersed in a binder resin solution.

Examples of the charge generation material include azo compounds such as sudan red and dian blue, quinone pigments such as pyrene quinone and anthoanthrone, quinocyanine pigments, perylene pigments, indigo pigments such as indigo and thioindigo, and phthalocyanine pigments such as hydroxygallium phthalocyanine, chlorogallium phthalocyanine, and titanylphthalocyanine. Among them, phthalocyanine pigments sensitive to 700 nm or longer are preferred. In particular, the charge generation material preferably includes a titanylphthalocyanine pigment, specifically, Y-titanylphthalocyanine (a titanylphthalocyanine pigment having a maximum diffraction peak at at least 27.3° as measured by Cu-Kα characteristic X-ray diffraction spectroscopy and having a very strong absorption at 780 nm, which will be referred to as Y—TiPh). It will be understood that the charge generation materials that may be used in the photoreceptor according to an embodiment of the present invention are not limited to these examples.

Any of these charge generation materials may be used alone or in the form of a dispersion in a known binder resin.

The binder resin used to form the charge generation layer may be a known resin, examples of which include, but are not limited to, polystyrene resins, polyethylene resins, polypropylene resins, acrylic resins, methacrylic resins, vinyl chloride resins, vinyl acetate resins, polyvinyl butyral resins, epoxy resins, polyurethane resins, phenolic resins, polyester resins, alkyd resins, polycarbonate resins, silicone resins, melamine resins, copolymer resins including two or more of these resins (such as vinyl chloride-vinyl acetate copolymer resins and vinyl chloride-vinyl acetate-maleic anhydride copolymer resins), and polyvinyl carbazole resins.

The charge generation layer is preferably formed by a process that includes preparing a coating liquid by dispersing, with a disperser, the charge generation material in a solution of the binder resin in a solvent, applying the coating liquid with a constant thickness by using a coater, and drying the coating film.

Examples of the solvent for dissolving and applying the binder resin used to form the charge generation layer include, but are not limited to, toluene, xylene, methyl ethyl ketone, cyclohexane, ethyl acetate, butyl acetate, methanol, ethanol, propanol, butanol, methyl cellosolve, ethyl cellosolve, tetrahydrofuran, 1,4-dioxane, 1,3-dioxolane, pyridine, and diethylamine.

Examples that can be used as means for dispersing the charge generation material include, but are not limited to, an ultrasonic disperser, a ball mill, a sand grinder, and a homomixer.

The mixing ratio of the charge generation material to the binder resin is preferably 1 to 600 parts by mass, more preferably 50 to 500 parts by mass of the charge generation material to 100 parts by mass of the binder resin. The charge generation layer preferably has a thickness of 0.01 to 5 μm, more preferably 0.05 to 3 μm, although it depends on the properties of the charge generation material, the properties and content of the binder resin, and other factors. Before the application, the coating liquid for the charge generation layer may be subjected to filtration for removal of contaminants and aggregates, so that the occurrence of image defects can be prevented. Alternatively, the charge generation layer can also be formed by vacuum deposition of the pigment.

<Charge Transport Layer>

In an embodiment of the present invention, the charge transport layer includes at least a charge transport material (CTM) and a binder resin and is formed by dissolving the charge transport material in a binder resin solution and applying the resulting solution.

The charge transport material may be a known compound, examples of which include carbazole derivatives, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, pyrazoline compounds, oxazolone derivatives, benzimidazole derivatives, quinazoline derivatives, benzofuran derivatives, acridine derivatives, phenazine derivatives, aminostilbene derivatives, triarylamine derivatives, phenylenediamine derivatives, stilbene derivatives, benzidine derivatives, poly-N-vinyl carbazole, poly-1-vinyl pyrene, and poly-9-vinyl anthracene. These compounds may be used alone or in a mixture of two or more.

The binder resin for use in the charge transport layer may be a known resin, examples of which include polycarbonate resins, polyacrylate resins, polyester resins, polystyrene resins, styrene-acrylonitrile copolymer resins, polymethacrylate resins, and styrene-methacrylate copolymer resins. Among them, polycarbonate resins are preferred. Bisphenol A (BPA)-, bisphenol Z (BPZ)-, and dimethyl BPA-type polycarbonate resins, and BPA-dimethyl-BPA-copolymer-type polycarbonate resins are more preferred in view of crack resistance, wear resistance, and charging characteristics.

The charge transport layer can be formed by a known method such as a coating method. For example, the desired charge transport layer can be formed by a coating method that includes preparing a coating liquid by dissolving the binder resin and the charge transport material in a solvent, applying the coating liquid with a constant thickness, and drying the coating.

Examples of the solvent for dissolving the binder resin and the charge transport material include toluene, xylene, methyl ethyl ketone, cyclohexanone, ethyl acetate, butyl acetate, methanol, ethanol, propanol, butanol, tetrahydrofuran, 1,4-dioxane, and 1,3-dioxolane. It will be understood that the solvents listed above are not intended to limit the range of the solvent for use in the preparation of the coating liquid for forming the charge transport layer.

The mixing ratio of the charge transport material to the binder resin is preferably 10 to 500 parts by mass, more preferably 20 to 100 parts by mass of the charge transport material to 100 parts by mass of the binder resin.

The charge transport layer preferably has a thickness of 5 to 40 μm, more preferably 10 to 30 μm, although it depends on the properties of the charge transport material and the binder resin, the mixing ratio between them, and other factors.

A known antioxidant may be added to the charge transport layer. For example, the antioxidant described in JP 2000-305291 A may be used.

<<Coating Method for Photoreceptor>>

A known coating method may be used to from each of the layers constituting the photoreceptor according to an embodiment of the present invention, such as the undercoat layer, the charge generation layer, the charge transport layer, and the surface protective layer. Specifically, the coating method may be dip coating, spray coating, spinner coating, bead coating, blade coating, beam coating, or circular quantity control coating. The circular quantity control coating is described in, for example, JP 58-189061 A and JP 2005-275373 A.

<<Electrophotographic Image Forming Apparatus>>

An electrophotographic image forming apparatus using the electrophotographic image forming method of an embodiment of the present invention includes the photoreceptor according to an embodiment of the present invention; a charging unit that has a charging device and is configured to charge the photoreceptor with the charging device; an exposure unit configured to form an electrostatic latent image by image exposure; a developing unit that has a developing device and is configured to form a toner image by developing the latent image with the developing device; a transfer unit configured to transfer the toner image onto a transfer medium such as a paper sheet or a transfer belt; and an electrostatic discharge unit. The toner image transferred directly on a copy sheet or the toner image transferred on a paper sheet through a transfer medium such as a transfer belt is turned into a visible image by means of a fixing unit configured to fix the toner image on a copy sheet by a fixing process such as a contact heating process. After the transfer, the toner remaining on the photoreceptor (the toner residue after the transfer) is removed by cleaning means such as a cleaning blade.

Figure 5:
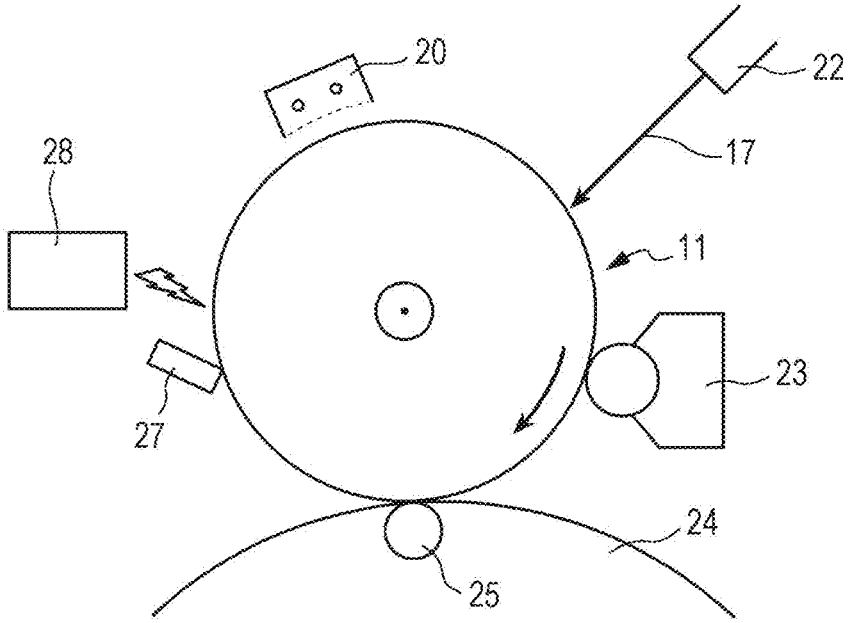
FIG. 5 is a schematic diagram illustrating an example of the structure of an electrophotographic image forming apparatus using an electrophotographic image forming method according to an embodiment of the present invention.

FIG. 5 is a schematic diagram illustrating an example of the structure of an electrophotographic image forming apparatus using the electrophotographic image forming method of an embodiment of the present invention. In the drawing, a reference numeral 27 represents a cleaning blade for the cleaning means, a reference numeral 28 represents a static discharger for the electrostatic discharge unit, a reference numeral 22 represents an exposure light source for the exposure unit, a reference numeral 20 represents a charging electrode for the charging unit, a reference numeral 23 represents a developing device for the developing unit, and a reference numeral 25 represents a transfer roller for the transfer unit. Examples of the exposure light source 22 that may be used include a tungsten lamp, a fluorescent lamp, a halogen lamp, a laser (a semiconductor laser or a He—Ne laser), and an LED.

The developing is for use in reversal development. The electrophotographic image forming method according to an embodiment of the present invention is effective in reducing transfer memory when a reversal development process is used. The static discharger 28 is effective at any time during the reversal development. The device described above is suitable for use as the static discharger 28.

A laser may be used as the exposure light source 22 in an example of the electrophotographic image forming method using a reversal development process. In this case, the photoreceptor 11 is charged with a negative polarity by means of the charging electrode 20, and the charged photoreceptor 11 is subjected to image exposure with the laser and then subjected to development with the developing device 23. In this case, reversal development is performed, in which therefore negatively charged toner is used. The toner image is transferred to a transfer medium 24 through the transfer roller 25. Subsequently, the charge on the photoreceptor 11 is removed by the static discharger 28.

As described above, when the electrostatic discharge is performed using the static discharger 28, at least an AC voltage at 2 kHz or more is applied, and the frequency of the AC voltage is increased depending on the use history.

The toner remaining on the photoreceptor 11 (the toner residue after transfer) is scraped off with the cleaning blade 27. The electrostatic discharge may be performed before or after the cleaning step. The transfer medium is a recording sheet such as a copy sheet, or a transfer belt. When the toner is transferred onto the transfer belt, the toner image is then formed by transferring the toner from the transfer belt to a recording sheet such as a copy sheet.

EXAMPLES

Hereinafter, the present invention will be more specifically described with reference to examples, which, however, are not intended to limit the present invention. As used in the examples, "parts" or "%" refers to "parts by mass" or "% by mass" unless otherwise specified.

[Preparation of Photoreceptors 1 to 12]

<<Preparation of Metal Oxide Fine Particles>>

(Preparation of Metal Oxide Fine Particles 1)

To a wet sand mill (containing alumina beads with a particle size of 0.5 mm) were added 100 parts by mass of tin oxide with a number average primary particle size of 20 nm as metal oxide fine particles (a component capable of influencing the frequency dependence of impedance), 30 parts by mass of illustrative compound S-15 as a coupling agent having a reactive organic group, and 1,000 parts by mass of methyl ethyl ketone. The materials were mixed at 30° C. for 6 hours. Subsequently, the methyl ethyl ketone and the alumina beads were separated by filtration. The resulting mixture was dried at 60° C. to give surface-modified metal oxide fine particles 1.

(Preparation of Metal Oxide Fine Particles 2 to 4)

Metal oxide fine particles 2 to 4 (components capable of influencing the frequency dependence of impedance) were prepared in the same manner as in the preparation of metal oxide fine particles 1, except that the type of metal oxide fine particles and the amount of the reactive organic group-containing coupling agent added to 100 parts by mass of the metal oxide fine particles were changed as shown in Table 1.

TABLE 1

| Metal oxide fine particles No. | Type of metal oxide fine particles | Number average primary particle size (nm) | Coupling agent: Type | Coupling agent: Added amount (parts by mass) based on 100 parts by mass of metal oxide fine particles |
|---|---|---|---|---|
| 1 | $SnO_2$ | 20 | S-15 | 30 |
| 2 | ZnO | 20 | S-15 | 25 |
| 3 | $TiO_2$ | 15 | S-15 | 40 |
| 4 | $Al_2O_3$ | 30 | S-15 | 20 |

<Preparation of Photoreceptor 1>

A photoreceptor 1 was prepared as described below.

A conductive support was prepared by cutting the surface of a cylindrical aluminum support with a diameter of 60 mm.

(Undercoat Layer)

A dispersion with the composition shown below was diluted 2-fold with the same solvent. The dilution was allowed to stand overnight and then filtered (with a 5 μm Rigimesh Filter manufactured by Pall Corporation) to give an undercoat layer-forming coating liquid.

Binder: Polyamide resin CM8000 (manufactured by Toray Industries, Inc.) 100 parts by mass Inorganic fine particles: Titanium oxide SMT500SAS (manufactured by Tayca Corporation) 300 parts by mass Solvent: Methanol 1,000 parts by mass 1-propanol 1,000 parts by mass The materials were dispersed for 10 hours using a same mill as a disperser.

The coating liquid was applied onto the conductive support by dip coating, so that an undercoat layer with a dry thickness of 2 μm was formed.

<Charge Generation Layer>

A charge generation layer-forming coating liquid was prepared by mixing 20 parts by mass of Y—TiPh (a titanylphthalocyanine pigment having a maximum diffraction peak at least at 27.3° in Cu-Kα characteristic X-ray diffraction spectroscopy and also having sufficiently large absorption at 780 nm) as a charge generation material, 10 parts by mass of a polyvinyl butyral resin (#6000-C manufactured by Denka Company Limited) as a binder, and 700 parts by mass of tert-butyl acetate and 300 parts by mass of 4-methoxy-4-methyl-2-pentanone as solvents, and dispersing the materials for 10 hours using a sand mill. The coating liquid was applied onto the undercoat layer by dip coating, so that a charge generation layer with a dry thickness of 0.3 μm was formed.

<Charge Transport Layer>

A charge transport layer-forming coating liquid was prepared by mixing 150 parts by mass of CTM-A as a charge transport material, 300 parts by mass of Polycarbonate Z (Z300 manufactured by MITSUBISHI GAS CHEMICAL COMPANY, INC.) as a binder, 6 parts by mass of Irganox 1010 (manufactured by BASF Japan Ltd.) as an antioxidant, 1,600 parts by mass of tetrahydrofuran and 400 parts by mass of toluene as solvents, and 0.25 parts by mass of silicone oil (KF-96 manufactured by Shin-Etsu Chemical Co., Ltd.) as an additive, and dissolving them. The coating liquid was applied onto the charge generation layer by dip coating, so that a charge transport layer with a dry thickness of 20 μm was formed.

The charge generation material (Y—TiPh) and the charge transport material (CTM-A) used as described above have the structural formulae shown below.

[Chemical Formula 7]

Y-TiPh

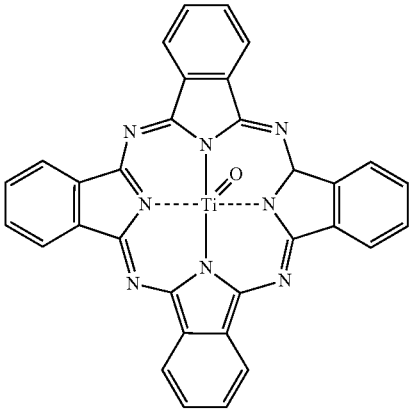

CTM-A

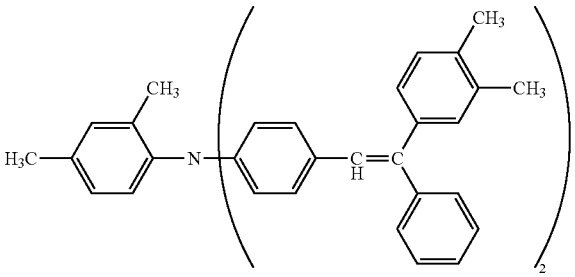

<Surface Protective Layer>

Surface-modified metal oxide fine particles 1 150 parts by mass

Crosslinking polymerizable compound: Illustrative compound M1 100 parts by mass

Polymerization initiator: IRGACURE 819 (manufactured by BASF Japan Ltd.) 15 parts by mass Solvent: 2-butanol 500 parts by mass These materials were sufficiently dissolved and dispersed by mixing and stirring to form a surface protective layer-forming coating liquid. Using a circular slide hopper coating machine, the surface protective layer-forming coating liquid was applied onto the photoreceptor, which was already obtained after the charge transport layer was formed. After the application, the coating was irradiated with ultraviolet rays from a xenon lamp for 1 minute so that a surface protective layer with a dry thickness of 2.0 μm was formed. In this way, photoreceptor 1 was obtained.

<Preparation of Photoreceptors 2 to 12>

The same coating process as in the preparation of the photoreceptor 1 was performed, except that the metal oxide fine particles (the component capable of influencing the frequency dependence of impedance) added to the surface protective layer and the metal oxide added to the undercoat layer were changed as shown in Table 2. After the coating process, drying was performed at 120° C. for 70 minutes, so that a surface protective layer with a dry thickness of 2.0 μm was obtained. In this way, photoreceptors 2 to 12 were obtained.

<Preparation of Photoreceptors 13 and 14>

A photoreceptor 13 was prepared in the same manner as in the preparation of the photoreceptor 1, except that the undercoat layer and the surface protective layer were replaced with those described below.

A photoreceptor 14 was prepared in the same manner as in the preparation of the photoreceptor 1, except that the surface protective layer was replaced with that described below.

(Preparation of Undercoat Layer for Photoreceptor 13)

Pretreatment 1 of Metal Oxide Fine Particles

With stirring, 500 parts by mass of zinc oxide fine particles (average particle size: 60 nm), 5 parts by mass of a silane coupling agent (KBM 503 manufactured by Shin-Etsu Chemical Co., Ltd.), and 3,000 parts by mass of toluene were mixed and then heat-treated at 120° C. for 1 hour to form surface-modified zinc oxide fine particles.

Pretreatment 2 of Metal Oxide Fine Particles

With heating at 40° C. for 10 hours, 500 parts by mass of the surface-modified zinc oxide fine particles, 10 parts by mass of alizarin, and 3,000 parts by mass of tetrahydrofuran (THF) were stirred and mixed. Subsequently, the mixture was filtered and then dried to give dye-treated zinc oxide fine particles.

Subsequently, a solution obtained by mixing 450 parts by mass of 2-butanone and 45 parts by mass of polyvinyl butyral (BL-S manufactured by SEKISUI CHEMICAL CO., LTD.) was mixed with 450 parts by mass of the dye-treated zinc oxide fine particles, 50 parts by mass of acrylic polyol (ACRYDIC A-814 manufactured by DIC Corporation, 50% in solid content), 100 parts by mass of a solution of 80% isocyanate (CORONATE 2507 manufactured by Tosoh Corporation), and 55 parts by mass of 2-propanol. The mixture was added together with zirconia beads (average particle size: 0.5 mm) to a sand mill and then dispersed for 10 hours to form a dispersion.

To the dispersion was added 0.002 parts by mass of dioctyl laurate, so that an undercoat layer-forming coating liquid was obtained.

The undercoat layer-forming coating liquid was applied onto the conductive support by dip coating and then heat-treated at 160° C. for 1 hour to form an undercoat layer for the photoreceptor 13. The undercoat layer had a dry thickness of 25 μm.

(Preparation of Surface Protective Layer for Photoreceptors 13 and 14)

Preparation of Dispersion of Modified Polytetrafluoroethylene (PTFE) Fine Particles With stirring, 6 parts by mass of polytetrafluoroethylene fine particles (PTFE, 0.2 μm in average particle size), 0.3 parts by mass of the fluoroalkyl-containing resin shown below, 45 parts by mass of cyclopentanone, and 5 parts by mass of 2-propanol were mixed and subjected to dispersion treatment using an ultrasonic homogenizer (NIHONSEIKI KAISHA LTD.), so that a dispersion of modified polytetrafluoroethylene (PTFE) fine particles (fine particles 5 including a fluororesin) was obtained.

[Chemical Formula 8]

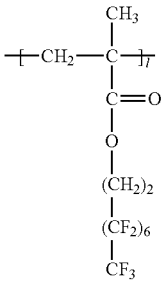

Fluoroalkyl-containing resin

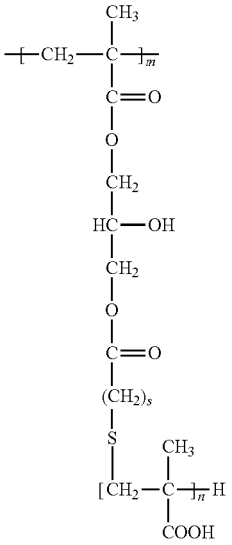

In the structural formula, the viscosity average molecular weight is 40,000, 1:m=1:1, and n=40.

Preparation of OCL Liquid Base

An OCL liquid base was prepared by mixing and stirring 6 parts by mass of a benzoguanamine compound (BL-60 manufactured by SANWA Chemical Co., Ltd., 60% in solid content), 80 parts by mass of charge transport material 1 (CTM-1 shown below), 20 parts by mass of charge transport material 2 (CTM-2 shown below), 180 parts by mass of cyclopentanone, and 20 parts by mass of 2-propanol.

[Chemical Formula 9]

CTM-1

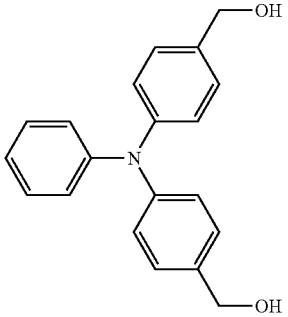

-continued

CTM-2

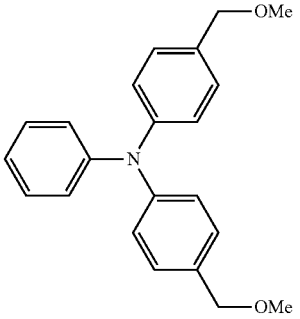

Preparation of Surface Protective Layer-Forming Coating Liquid

The dispersion of modified polytetrafluoroethylene (PTFE) fine particles and the OCL liquid base were mixed and stirred and then subjected to mixing and dispersing treatment using Nanomizer (YOSHIDA KIKAI CO., LTD.). Subsequently, 0.1 parts by mass of dodecylbenzenesulfonic acid (NACURE 5225 manufactured by King Industries, Inc.) as a curing catalyst was added to the treated liquid and then mixed to form a surface protective layer-forming coating liquid.

Using a circular slide hopper coating machine, the surface protective layer-forming coating liquid was applied onto the photoreceptor, which was obtained after the charge transport layer was formed. After the application, the coating was heat-treated at 160° C. for 30 minutes to form a surface protective layer with a dry thickness of 2.0 μm.

<Preparation of Photoreceptors 15 and 16>

A photoreceptor 15 was prepared in the same manner as in the preparation of the photoreceptor 1, except that hydroxygallium phthalocyanine was used instead of Y—TiPh as the charge generation material for the charge generation layer.

A photoreceptor 16 was prepared in the same manner as in the preparation of the photoreceptor 1, except that chlorogallium phthalocyanine was used instead of Y—TiPh as the charge generation material for the charge generation layer.

TABLE 2

| | Composition of photoreceptor | |
|---|---|---|
| Photoreceptor No. | Surface protective layer Metal oxide fine particles No. or fluororesin-containing fine particles No. | Undercoat layer Metal oxide |
| 1 | 1 | $TiO_2$ |
| 2 | 1 | ZnO |
| 3 | 1 | $Al_2O_3$ |
| 4 | 2 | $TiO_2$ |
| 5 | 4 | $TiO_2$ |
| 6 | 3 | $TiO_2$ |
| 7 | 1 | — |
| 8 | 2 | — |
| 9 | — | $TiO_2$ |
| 10 | — | ZnO |
| 11 | — | $Al_2O_3$ |
| 12 | — | — |
| 13 | 5 | ZnO |
| 14 | 5 | $TiO_2$ |
| 15 | 1 | $TiO_2$ |
| 16 | 1 | $TiO_2$ |

<<Evaluation>>

These photoreceptors were each installed in an evaluation machine that was obtained as a modification of bizhub PRO C6500 as described below.

Using each of the photoreceptors, actual printing on 1,000,000 sheets was evaluated, in which wear resistance (abrasion resistance and scratch resistance) and potential stability were evaluated as described below. The results are shown in Table 4 below.

[Preparation of Evaluation Machine]

A digital full-color multifunction machine bizhub PRO C6500 (manufactured by KONICA MINOLTA, INC.) was modified to form an evaluation machine, in which a corona discharger was placed as a static discharger between the cleaning blade and the electrostatic discharge lamp and connected to an external high-voltage power source so that AC voltages at any frequency and DC bias could be applied. The frequency of the AC voltage was variable continuously. The electrostatic discharge lamp was also modified so that light irradiation could be performed as desired.

<Abrasion Resistance and Scratch Resistance>

Evaluations were performed on the initial thickness and the thickness after the printing on 1,000,000 sheets. The thickness of the photoreceptor was defined as the average of the thicknesses measured at 10 sites randomly selected in a uniform thickness portion of the photoreceptor (at least 3 cm-long portions from both ends were excluded because the thickness of both end portions of the photoreceptor tend to be non-uniform). The thickness was measured using an eddy current thickness meter (ISOSCOPE FMP30 manufactured by Fischer Instruments). The difference between the thicknesses of the photoreceptor before and after the actual printing test was determined as the amount of thickness reduction ΔHd and used in the evaluation of abrasion resistance and scratch resistance to actual printing.

(Evaluation Criteria)

⊙: ΔHd is less than 2 μm (good).

○: ΔHd is from 2 μm to less than 4 μm (acceptable for practical use).

Δ: ΔHd is from 4 μm to less than 6 μm (slightly not good for practical use).

x: ΔHd is 6 μm or more (not good for practical use).

<Scratch-Induced Image Quality Defects>

A halftone image was printed over the surface of A3 size sheets, and scratch-induced image quality defects were visually evaluated as shown below.

(Evaluation Criteria)

○: No halftone image quality defects are observed (good).

Δ: Halftone image quality defects are slightly observed (slightly not good for practical use).

x: Halftone image quality defects are clearly observed (not good for practical use).

<Potential Stability>

The repetition potential was measured as described below. Printing on 1,000,000 sheets was performed, in which the charge potential and the exposure potential on an unexposed part of the photoreceptor at the developing device after the charging was measured at the first print and at the 1,000,000th print, respectively, using an electrometer installed in the evaluation machine. The absolute value ΔVo of the difference between the measured charge potentials and the absolute value ΔVi of the difference between the measured exposure potentials were calculated and evaluated based on the criteria below.

(Criteria for the Evaluation of Charge Potential)

⊙: ΔVo is less than 50 V (good).

○: ΔVo is from 50 V to less than 100 V (acceptable for practical use).

Δ: ΔVo is from 100 V to less than 150 V (slightly not good for practical use).

x: ΔVo is 150 V or more (not good for practical use).

(Criteria for the Evaluation of Exposure Potential)

⊙: ΔVi is less than 100 V (good).

○: ΔVi is from 100 V to less than 150 V (acceptable for practical use).

Δ: ΔVi is from 150 V to less than 200 V (slightly not good for practical use).

x: ΔVi is 200 V or more (not good for practical use).

[Evaluation of Image Forming Method]

Using each of the photoreceptors 1 to 16 under different electrostatic discharge conditions, actual printing evaluation was performed after the initial printing (printing on the first sheet) and after printing on 1,000,000 sheets, and image memory was evaluated as described below.

<Evaluation 1 of Image Memory>

The original document shown in FIG. 1A was copied under the electrostatic discharge conditions shown in Tables 3 and 4. A copied image density difference ΔD between halftone areas at the second cycle of the photoreceptor, which correspond to the solid black area and the halftone area of the original document at the first cycle of the photoreceptor, was evaluated using a Macbeth reflection densitometer (RD-918 manufactured by Macbeth). Tables 3 and 4 show the results.

When light electrostatic discharge was performed simultaneously with the application of an AC voltage (light electrostatic discharge shown in Tables 3 and 4), light at 630 nm was applied from an LED to the photoreceptor while an AC voltage was applied thereto.

When a DC bias was applied in addition to an AC voltage, a DC voltage of −500 V was applied, on which the AC voltage was superimposed.

When light electrostatic discharge was performed simultaneously with the application of an AC voltage and a DC bias, the application of the DC bias and the light electrostatic discharge were performed under the same conditions as those described above.

(Evaluation Criteria)

⊙: ΔD is less than 0.01 (very good).

○: ΔD is from 0.01 to less than 0.02 (good).

Δ: ΔD is from 0.02 to less than 0.03 (slightly not good for practical use).

x: ΔD is 0.03 or more (not good for practical use).

TABLE 3

| | Initial Image memory Electrostatic discharge conditions (the value is the frequency (kHz) of AC voltage) | | | | | |
|---|---|---|---|---|---|---|
| Photoreceptor No. | 0 | 1 | 2 | 3 | 2 (with DC bias) | 2 (with light electrostatic discharge) |
| 1 | Δ | Δ | ○ | ○ | ○ | ○ |
| 2 | Δ | Δ | ○ | ○ | ○ | ○ |
| 3 | Δ | Δ | ○ | ○ | ○ | ○ |
| 4 | Δ | Δ | ○ | ○ | ○ | ○ |
| 5 | Δ | Δ | ○ | ○ | ○ | ○ |
| 6 | Δ | Δ | ○ | ○ | ○ | ○ |
| 7 | Δ | Δ | ○ | ○ | ○ | ○ |
| 8 | Δ | Δ | ○ | ○ | ○ | ○ |
| 9 | Δ | ○ | ○ | ○ | ○ | ○ |
| 10 | Δ | ○ | ○ | ○ | ○ | ○ |
| 11 | Δ | ○ | ○ | ○ | ○ | ○ |
| 12 | Δ | ○ | ○ | ○ | ○ | ○ |
| 13 | Δ | Δ | ○ | ○ | ○ | ○ |
| 14 | Δ | Δ | ○ | ○ | ○ | ○ |
| 15 | Δ | Δ | ○ | ○ | ○ | ○ |
| 16 | Δ | Δ | ○ | ○ | ○ | ○ |

TABLE 4

| | After printing on 1,000,000 sheets | | | | | | | | | | | |
|---|---|---|---|---|---|---|---|---|---|---|---|---|
| | Image memory Electrostatic discharge conditions (the value is the frequency (kHz) of AC voltage) | | | | | | | | | Resistance to abrasion and scratching | | |
| Photoreceptor No. | 1 | 2 | 3 | 2 (with DC bias) | 2 (with light electrostatic discharge) | 1.5 (with DC bias) | 1.5 (with light electrostatic discharge) | 1.5 (with DC bias and light electrostatic discharge) | ΔH | (Scratch-induced image quality defects | Potential stability ΔVo | ΔVi |
| 1 | X | Δ | ○ | ○ | ○ | Δ | Δ | ○ | ⊙ | ○ | ○ | ○ |
| 2 | X | Δ | ○ | ○ | ○ | Δ | Δ | ○ | ⊙ | ○ | ○ | ○ |
| 3 | X | Δ | ○ | ○ | ○ | Δ | Δ | ○ | ⊙ | ○ | ○ | ○ |
| 4 | X | Δ | ○ | ○ | ○ | Δ | Δ | ○ | ⊙ | ○ | ○ | ○ |
| 5 | X | Δ | Δ | ○ | ○ | X | Δ | Δ | ⊙ | ○ | ○ | ○ |
| 6 | X | Δ | Δ | ○ | ○ | X | X | Δ | ⊙ | ○ | ○ | ○ |
| 7 | X | Δ | ○ | ○ | ○ | X | Δ | ○ | ⊙ | ○ | X | X |
| 8 | X | Δ | Δ | ○ | ○ | X | X | Δ | ⊙ | ○ | X | X |
| 9 | Δ | Δ | ○ | ○ | ○ | Δ | Δ | Δ | X | X | ○ | ○ |
| 10 | Δ | Δ | ○ | ○ | ○ | Δ | Δ | Δ | X | X | ○ | ○ |
| 11 | Δ | Δ | ○ | ○ | ○ | Δ | Δ | Δ | X | X | ○ | ○ |
| 12 | Δ | Δ | ○ | ○ | ○ | Δ | Δ | Δ | X | X | X | X |
| 13 | X | Δ | ○ | ○ | ○ | Δ | Δ | ○ | ⊙ | ○ | ○ | Δ |
| 14 | X | Δ | ○ | ○ | ○ | Δ | Δ | ○ | ⊙ | ○ | ○ | Δ |
| 15 | X | Δ | ○ | ○ | ○ | Δ | Δ | ○ | ⊙ | ○ | ○ | ○ |
| 16 | X | Δ | ○ | ○ | ○ | Δ | Δ | ○ | ⊙ | ○ | ○ | ○ |

Tables 3 and 4 show that when electrostatic discharge was performed with an AC voltage applied at a frequency of less than 2 kHz, the photoreceptors having the surface protective layer containing a component capable of influencing the frequency dependence of impedance, such as metal oxide fine particles or fluororesin fine particles (the photoreceptors 1 to 8 and 13 to 16) were all practically unusable in terms of image memory particularly after printing on 1,000,000 sheets (after an increased use history). This also applied to the case where the DC bias or light was applied in addition to the AC voltage.

However, it has been suggested from the results that if the frequency of the AC voltage used for electrostatic discharge is increased depending on the use history, image memory can be reduced to the same level as for the photoreceptors 9 to 12 not having a component capable of influencing the frequency dependence of impedance, such as metal oxide fine particles or fluororesin fine particles.

Based on the results, image memory is evaluated when the frequency of the AC voltage used for electrostatic discharge is increased depending on the use history.

<Evaluation 2 of Image Memory>

Image memory was evaluated as described above while the frequency of the AC voltage in the step of performing electrostatic discharge with the AC voltage was increased by 8% from the next previous frequency every time printing on 100,000 sheets was performed. The results are shown in Table 5.

TABLE 5

| | Image memory Number of printed sheets (×10,000) | | | | | | | | | | | | Resistance to abrasion and scratching | | | |
|---|---|---|---|---|---|---|---|---|---|---|---|---|---|---|---|---|
| | Frequency (kHz) of AC voltage | | | | | | | | | | | | Scratch-induced | Potential | | |
| Photoreceptor | Initial | 10 | 20 | 30 | 40 | 50 | 60 | 70 | 80 | 90 | 100 | | image quality | stability | | |
| No. | 2.00 | 2.16 | 2.33 | 2.52 | 2.72 | 2.94 | 3.17 | 3.43 | 3.70 | 4.00 | 4.32 | ΔH | defects | ΔVo | ΔVi | Note |
| 1 | ○ | ○ | ○ | ○ | ○ | ○ | ○ | ○ | ○ | ○ | ○ | ⊙ | ○ | ○ | ○ | Invention |
| 3 | ○ | ○ | ○ | ○ | ○ | ○ | ○ | ○ | ○ | ○ | ○ | ⊙ | ○ | ○ | ○ | Invention |
| 5 | ○ | ○ | ○ | ○ | ○ | ○ | ○ | ○ | ○ | ○ | ○ | ⊙ | ○ | ○ | ○ | Invention |
| 9 | ○ | ○ | ○ | ○ | ○ | ○ | ○ | ○ | ○ | ○ | ○ | X | X | ○ | ○ | Comparative Example |

<Evaluation 3 of Image Memory>

Image memory was evaluated as described above while the frequency of the AC voltage in the step of performing electrostatic discharge with the AC voltage was increased by 4% from the next previous frequency every time printing on 100,000 sheets was performed. The results are shown in Table 6.

TABLE 6

| Photoreceptor | Image memory Number of printed sheets (×10,000) Frequency (kHz) of AC voltage Initial | 10 | 20 | 30 | 40 | 50 | 60 | 70 | 80 | 90 | 100 | | Resistance to abrasion and scratching Scratch-induced image quality | Potential stability | | |
|---|---|---|---|---|---|---|---|---|---|---|---|---|---|---|---|---|
| No. | 2.00 | 2.08 | 2.16 | 2.25 | 2.34 | 2.43 | 2.53 | 2.63 | 2.74 | 2.85 | 2.96 | ΔH | defects | ΔVo | ΔVi | Note |
| 1 | ○ | ○ | ○ | ○ | ○ | ○ | ○ | ○ | ○ | ○ | ○ | ⊙ | ○ | ○ | ○ | Invention |
| 3 | ○ | ○ | ○ | ○ | ○ | ○ | ○ | ○ | ○ | ○ | ○ | ⊙ | ○ | ○ | ○ | Invention |
| 5 | ○ | ○ | ○ | ○ | ○ | ○ | ○ | Δ | Δ | Δ | Δ | ⊙ | ○ | ○ | ○ | Invention |
| 9 | ○ | ○ | ○ | ○ | ○ | ○ | ○ | ○ | ○ | ○ | ○ | X | X | ○ | ○ | Comparative Example |

<Evaluation 4 of Image Memory>

Image memory was evaluated as described above while the frequency of the AC voltage in the step of performing electrostatic discharge with the AC voltage was increased by 4% from the next previous frequency every time printing on 100,000 sheets was performed and −500 V for a DC bias was applied in the electrostatic discharge. The results are shown in Table 7.

The above results have shown that the electrophotographic image forming method of an embodiment of the present invention is superior to the method of the comparative example with respect to both mechanical strength and occurrence of image memory.

According to an embodiment of the present invention, the above means according to an embodiment of the present invention make it possible to provide an electrophotographic image forming method in which transfer memory and photomemory can be reduced while mechanical strength is maintained.

TABLE 7

| Photoreceptor | Image memory Number of printed sheets (×10,000) Frequency (kHz) of AC voltage Initial | 10 | 20 | 30 | 40 | 50 | 60 | 70 | 80 | 90 | 100 | | Resistance to abrasion and scratching Scratch-induced image quality | Potential stability | | |
|---|---|---|---|---|---|---|---|---|---|---|---|---|---|---|---|---|
| No. | 2.00 | 2.08 | 2.16 | 2.25 | 2.34 | 2.43 | 2.53 | 2.63 | 2.74 | 2.85 | 2.96 | ΔH | defects | ΔVo | ΔVi | Note |
| 1 | ○ | ○ | ○ | ○ | ○ | ○ | ○ | ○ | ○ | ○ | ○ | ⊙ | ○ | ○ | ○ | Invention |
| 3 | ○ | ○ | ○ | ○ | ○ | ○ | ○ | ○ | ○ | ○ | ○ | ⊙ | ○ | ○ | ○ | Invention |
| 5 | ○ | ○ | ○ | ○ | ○ | ○ | ○ | ○ | ○ | ○ | ○ | ⊙ | ○ | ○ | ○ | Invention |
| 9 | ○ | ○ | ○ | ○ | ○ | ○ | ○ | ○ | ○ | ○ | ○ | X | X | ○ | ○ | Comparative Example |

<Evaluation 5 of Image Memory>

As a comparative example, image memory was evaluated as described above when printing on 1,000,000 sheets was performed with the frequency of the AC voltage kept unchanged at 2 kHz in the step of performing electrostatic discharge with the AC voltage. The results are shown in Table 8.

Why and how the effects of an embodiment of the present invention are produced, although not clear, may be as follows.

TABLE 8

| Photoreceptor | Image memory Number of printed sheets (×10,000) Frequency (kHz) of AC voltage Initial | 10 | 20 | 30 | 40 | 50 | 60 | 70 | 80 | 90 | 100 | | Resistance to abrasion and scratching Scratch-induced image quality | Potential stability | | |
|---|---|---|---|---|---|---|---|---|---|---|---|---|---|---|---|---|
| No. | 2.00 | 2.00 | 2.00 | 2.00 | 2.00 | 2.00 | 2.00 | 2.00 | 2.00 | 2.00 | 2.00 | ΔH | defects | ΔVo | ΔVi | Note |
| 1 | ○ | ○ | ○ | ○ | ○ | ○ | Δ | Δ | Δ | Δ | Δ | ⊙ | ○ | ○ | ○ | Comparative Example |
| 3 | ○ | ○ | ○ | ○ | Δ | Δ | Δ | Δ | Δ | Δ | Δ | ⊙ | ○ | ○ | ○ | Comparative Example |
| 5 | ○ | ○ | ○ | Δ | Δ | Δ | Δ | Δ | Δ | Δ | Δ | ⊙ | ○ | ○ | ○ | Comparative Example |
| 9 | ○ | ○ | ○ | ○ | ○ | ○ | ○ | ○ | Δ | Δ | Δ | X | X | ○ | ○ | Comparative Example |

The inventor suggests the following model for the occurrence of transfer memory in a reversal development process.

The polarity in the transfer step is reverse to the polarity of the electrostatic charge. In the next cycle, the photoreceptor can slightly change in the property of being charged and the photosensitivity, depending on the level of the electrostatic charge with the reverse polarity. Therefore, the difference in the level of the reverse polarity charge on the photoreceptor for the previous cycle image itself can cause the change in the next cycle so that reverse charge memory (transfer memory) can occur.

Figure 1B:
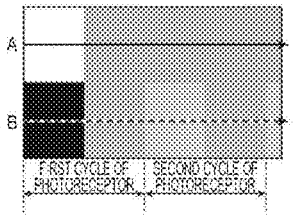
Figure 1C:
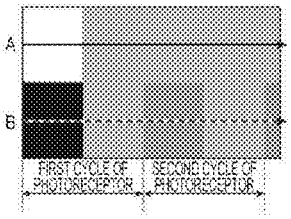
Figure 1D:
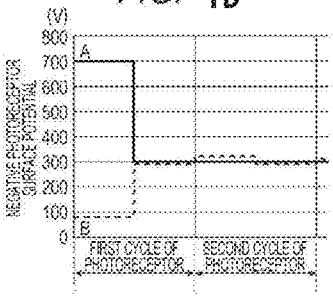
Figure 1E:
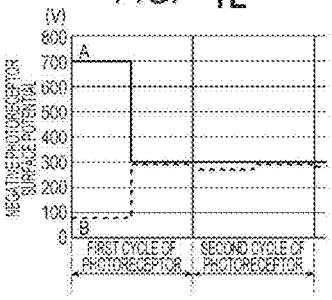

Specifically, in the process of copying the original document shown in FIG. 1A, transfer memory can occur when at the second cycle of the photoreceptor, the negative photoreceptor surface potential (hereinafter also simply referred to as the "surface potential") of a halftone area corresponding to a part (solid black part) of the image at the first cycle of the photoreceptor is higher or lower than the surface potential of a halftone area corresponding to the halftone part at the first cycle. In the reversal development process, when the surface potential of the halftone area at the second cycle of the photoreceptor is higher than that of the halftone area at the first cycle of the photoreceptor, the halftone image density at the corresponding area becomes lower (referred to as "negative memory" (FIG. 1B)), and when the surface potential at the second cycle of the photoreceptor is lower than that at the first cycle of the photoreceptor (FIG. 1E), the halftone image density becomes higher (referred to as "positive memory" (FIG. 1C)). In this regard, the surface potential of the area indicated by line A in FIGS. 1B and 1C correspond to the surface potential indicated by line A in FIGS. 1D and 1E, respectively. The surface potential of the area indicated by line B in FIGS. 1B and 1C correspond to the surface potential indicated by line B in FIGS. 1D and 1E, respectively.

In not a few cases, however, the surface potential difference is not observed if there are the same amounts of positive and negative charges in an actual system (specifically, if the bulk of a surface protective layer is neutral as a whole even though locally polarized).

Thus, the inventor has provided a model in which when a voltage with a polarity reverse to that of electrostatic charge on the photoreceptor is applied in the transfer step, the bulk of a surface protective layer is locally polarized (hereinafter such a state is also referred to as a "trap").

The inventor has concluded that when a trap is formed in a surface protective layer by the reverse polarity charging in an electrophotographic image forming method using a photoreceptor having the surface protective layer, electrostatic discharge by applying an AC voltage at a specific frequency (of 2 kHz or more) can release the trap with no adverse effect on the step of forming a latent image, so that transfer memory can be reduced.

As a result of experiments to reduce transfer memory in a reversal development process, the inventor has also found that the frequency dependence of the impedance of the photoreceptor changes depending on use history and this change significantly contributes to the occurrence of transfer memory.

This finding will be explained below.

First, a photoreceptor is generally considered to be an equivalent circuit to a parallel circuit of a capacitor (C [F]) and a resistor (Rp [Ω]).

When AC is applied to the photoreceptor, the resistance of the capacitor C is represented by the reactance $Xp=1/\omega C$. In this formula, $\omega=2\pi f$, wherein f is the frequency (Hz).

In this case, the impedance Z is expressed by the following formula:

$$Z = \frac{1}{\sqrt{(1-/Rp)^2 + (1/Xp)^2}} \quad \text{[Mathematical Formula 1]}$$

In a dark place, the parallel resistance Rp of the photoreceptor is high enough. Therefore, if Rp is sufficiently higher than Xp, the influence of Rp on the impedance Z is almost negligible. In a dark place, therefore, the impedance Z is determined by Xp (the component of C).

However, this will not apply if the use history becomes heavy.

This will be explained with reference to FIGS. 2A to 2D. In FIGS. 2A to 2D, the vertical axis represents Z, Xp, or Rp (Ω), and the horizontal axis represents frequency f (Hz).

For example, when there is no surface protective layer (FIG. 2A), the regression lines Lr and Lx for Rp and Xp, respectively, are parallel to each other, and it is apparent that the impedance Z is determined by Xp.

Figure 2A:
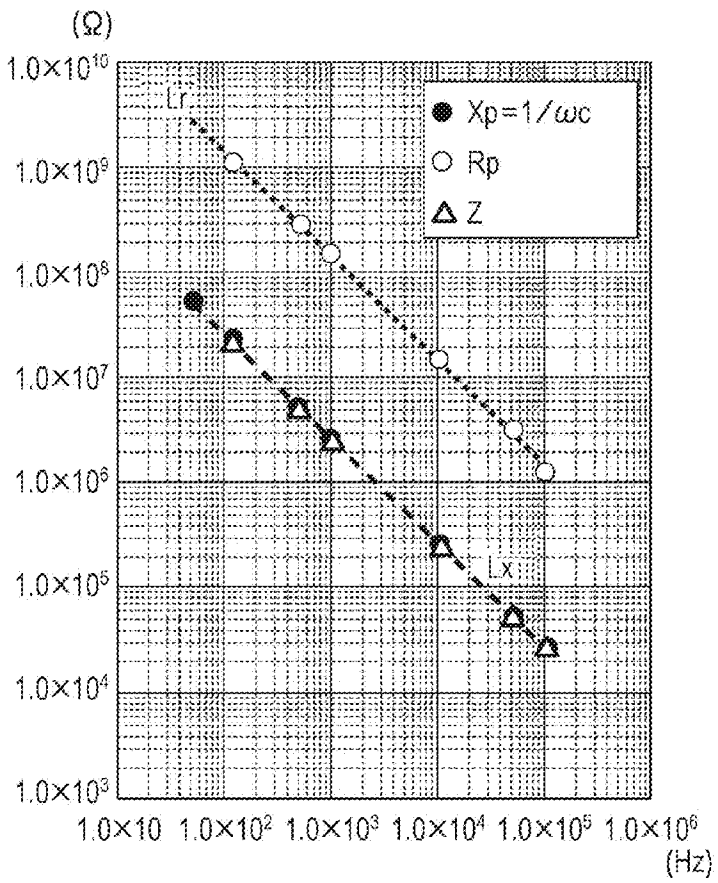
FIGS. 2A, 2B, 2C, and 2D are graphs for explaining how the frequency dependence of impedance changes depending on use history.
Figure 2B:
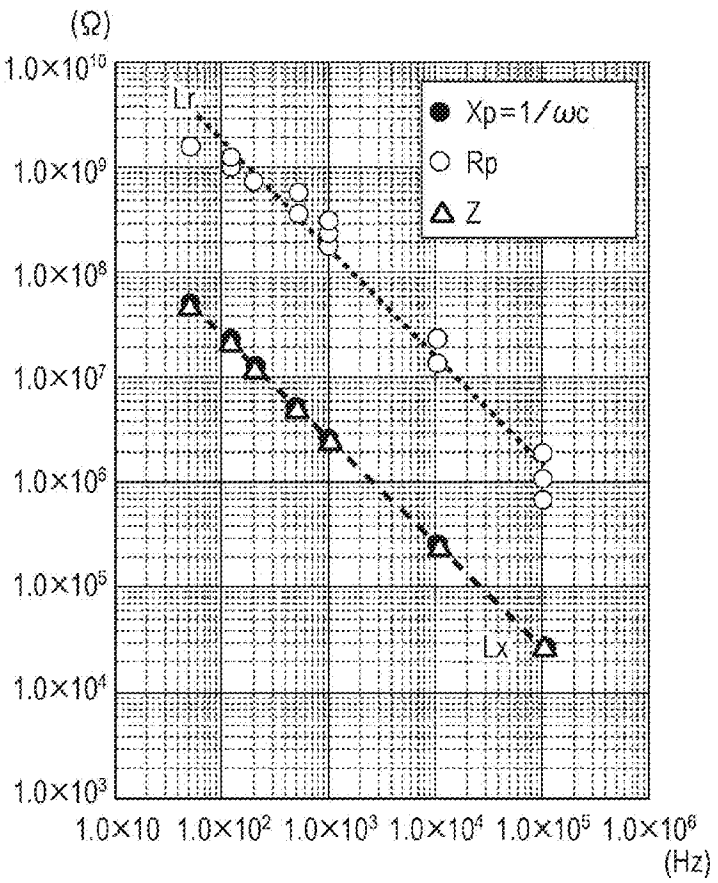
Figure 2C:
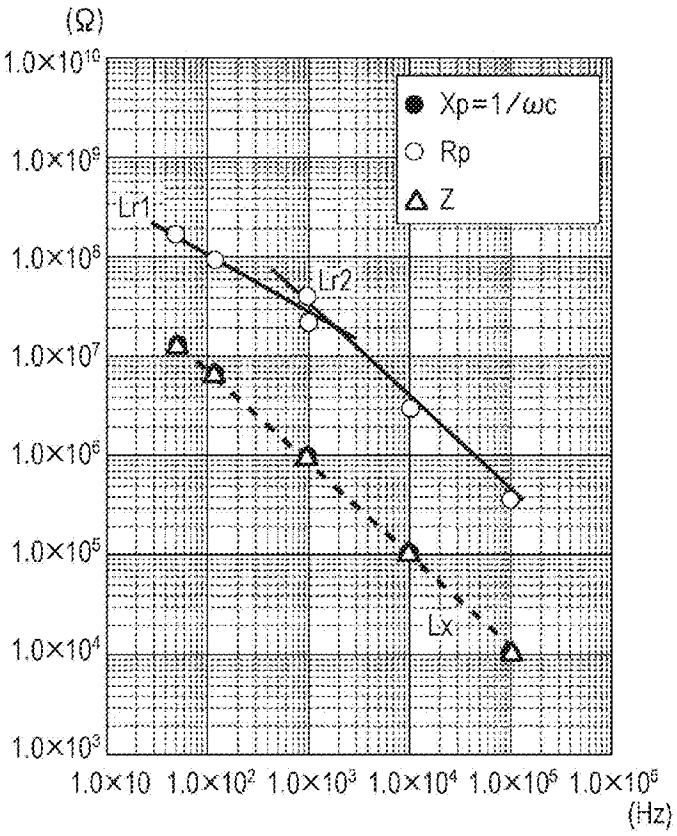
Figure 2D:
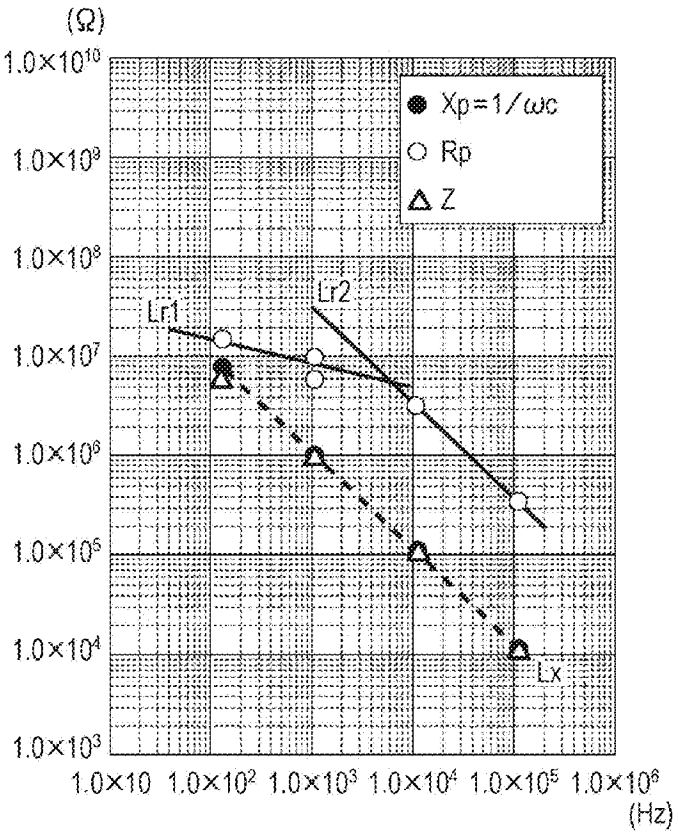

FIG. 2B shows that also when the photoreceptor has a surface protective layer and its use history is not heavy (or it does not deteriorate), the regression lines Lr and Lx for Rp and Xp, respectively, are parallel to each other and that the impedance Z does not deviate from Xp and is highly dependent on Xp.

In this regard, the capacitance C is inversely proportional to the thickness d. Therefore, the value of the impedance Z decreases with increasing use history (or decreasing thickness d). This may suggest that regardless of use history, the regression lines for the impedance Z, resistance Rp, and reactance Xp may be kept almost parallel to one another depending on the decrease in the thickness d due to the wear of the photoreceptor. In fact, however, as the use history becomes heavier, not only the thickness d decreases, but also electrical degradation (degradation due to the passage of charges) occurs. Therefore, the regression lines for the impedance Z, resistance Rp, and reactance Xp seem to become not parallel to one another as the use history becomes heavier.

For example, as for the surface protective layer-containing photoreceptor after printing on 500,000 sheets (FIG. 2C), the regression line Lr1 for Rp in the frequency region of 0 to 1,000 Hz is not parallel to the regression line Lx for Xp and has a slope whose absolute value is smaller. On the other hand, the regression line Lr2 for Rp in the frequency region of 1,000 Hz or more is parallel to the regression line Lx for Xp.

As for the surface protective layer-containing photoreceptor after printing on 1,000,000 sheets (FIG. 2D), the regression line Lr1 for Rp in the frequency region of 0 to 1,000 Hz is not parallel to the regression line Lx for Xp and has a slope whose absolute value is much smaller. Therefore, it is also suggested that Z should be lower than Xp in the frequency region of 0 to 1,000 Hz. On the other hand, in the frequency region of 1,000 Hz or more, the regression line Lr2 for Rp is parallel to the regression line Lx for Xp, and the impedance Z is highly dependent on Xp, so that the frequency dependence of the impedance Z will be low.

The inventor has found that particularly in the frequency region of 0 to 1,000 Hz, Rp becomes unstable as the use history becomes heavier, but in a specific frequency region (particularly of 2 kHz or more), the frequency dependence of the impedance Z can be reduced so that electrostatic discharge can be successfully performed on the photoreceptor and transfer memory can be reduced.

As a result, the inventor has also found that an electrostatic discharge step that includes applying an AC voltage at 2 kHz or more, wherein the frequency of the AC voltage is increased depending on use history, can release charges (trap) accumulated in the bulk of the surface protective layer and at the interface between the charge transport layer (CTL) and the surface protective layer (OCL) and is successful for electrostatic discharge.

The inventor has revealed that if such an electrostatic discharge step is performed, the surface potential of the photoreceptor can be always set neutral when the next electrophotographic image forming process is allowed to proceed, so that transfer memory and photo-memory can be reduced while the mechanical strength is maintained by the surface protective layer-containing photoreceptor, thus arriving at the present invention.

Although the present invention has been described and illustrated in detail, it is clearly understood that the same is by way of illustrated and example only and is not to be taken byway of limitation, the scope of the present invention being interpreted by terms of the appended claims.

What is claimed is:

1. An electrophotographic image forming method comprising:

performing a reversal development process by charging a surface of an electrophotographic photoreceptor comprising a conductive support, an undercoat layer, a photosensitive layer, and a surface protective layer, which are at least provided on the conductive support, wherein the surface protective layer comprises at least a cured resin and a component capable of influencing frequency dependence of impedance, and the undercoat layer comprises at least a metal oxide and has a thickness in the range of 1 to 30 μm;

exposing the surface of the electrophotographic photoreceptor to light to form an electrostatic latent image;

developing the electrostatic latent image with a toner to form a toner image;

transferring the toner image onto a transfer sheet; and removing a static electricity from the electrophotographic photoreceptor by applying an AC voltage at 2 kHz or more, wherein the frequency of the AC voltage is increased every predetermined number of printed sheets, and the predetermined number is 10,000 to 100,000, wherein the static electricity is a charge remaining from the charging of the surface of the electrophotographic photoreceptor after the exposing of the surface of the electrophotographic photoreceptor, and wherein the reversal development process is repeated so as to print the predetermined number of printed sheets.

2. The electrophotographic image forming method according to claim 1, wherein the component capable of influencing frequency dependence of impedance is fine particles comprising at least tin oxide, zinc oxide, titanium oxide, or aluminum oxide or fine particles comprising a fluororesin.

3. The electrophotographic image forming method according to claim 1, wherein the cured resin is a resin obtained by polymerization of a polymerizable monomer having at least an acryloyl or methacryloyl group in its molecule.

4. The electrophotographic image forming method according to claim 1, wherein the cured resin comprises fluororesin fine particles and a fluoroalkyl group-containing resin.

5. The electrophotographic image forming method according to claim 1, wherein the metal oxide contained in the undercoat layer is in the form of fine particles comprising at least tin oxide, zinc oxide, titanium oxide, or aluminum oxide.

6. The electrophotographic image forming method according to claim 1, wherein the photosensitive layer has a layer comprising at least a charge generation material, wherein the charge generation material comprises at least Y-titanylphthalocyanine.

7. The electrophotographic image forming method according to claim 1, wherein in removing the static electricity, a DC voltage with the same polarity as the polarity of electrostatic charge on the electrophotographic photoreceptor is applied in addition to the AC voltage.

8. The electrophotographic image forming method according to claim 1, wherein in removing the static electricity, light for electrostatic discharge is applied simultaneously with the application of the AC voltage.

9. The electrophotographic image forming method according to claim 7, wherein in removing the static electricity, light for electrostatic discharge is applied simultaneously with the application of the AC voltage and the DC voltage.

* * * * *